United States Patent [19]

Horiuti et al.

[11] Patent Number: 5,074,957

[45] Date of Patent: Dec. 24, 1991

[54] METHOD OF MANUFACTURING ULTRA-BLACK FILM

[75] Inventors: Masao Horiuti; Shunichi Kodama, both of Tokyo; Kenji Kuroda, Hadano, all of Japan

[73] Assignee: Anritsu Corporation, Tokyo, Japan

[21] Appl. No.: 595,608

[22] Filed: Oct. 11, 1990

Related U.S. Application Data

[62] Division of Ser. No. 268,509, Nov. 8, 1988, Pat. No. 4,984,855.

[30] Foreign Application Priority Data

| | | | |
|---|---|---|---|
| Nov. 10, 1987 | [JP] | Japan | 62-283878 |
| Jan. 9, 1988 | [JP] | Japan | 63-2914 |
| Feb. 27, 1988 | [JP] | Japan | 63-45569 |
| Sep. 16, 1988 | [JP] | Japan | 63-231760 |
| Sep. 16, 1988 | [JP] | Japan | 63-231761 |
| Sep. 30, 1988 | [JP] | Japan | 63-127194[U] |
| Sep. 30, 1988 | [JP] | Japan | 63-127195[U] |
| Sep. 30, 1988 | [JP] | Japan | 63-244228 |

[51] Int. Cl.[5] ..... B44C 1/22; C23F 1/00

[52] U.S. Cl. ..... 156/651; 156/656; 156/664; 252/79.2; 427/305

[58] Field of Search ..... 156/651, 656, 664; 427/304, 305, 307, 309, 336, 352, 404, 443.1; 148/6.14 R, 6.15 R, 253, 284, 286; 350/1.1; 428/472.1, 472.2, 473.3; 252/79.2

[56] References Cited

U.S. PATENT DOCUMENTS

| | | | |
|---|---|---|---|
| 3,208,447 | 9/1965 | Laszlo | 126/270 |
| 3,357,584 | 12/1967 | Hays | 117/130 |
| 4,122,239 | 10/1978 | Riboulet et al. | 428/621 |
| 4,209,008 | 6/1980 | Lemkey et al. | 126/452 |
| 4,233,107 | 11/1980 | Johnson, Sr. | 156/632 |
| 4,361,630 | 11/1982 | Johnson, Sr. | 428/613 |
| 4,511,614 | 4/1985 | Greeson et al. | 428/141 |
| 4,984,855 | 1/1991 | Horiuti et al. | 350/1.1 |

FOREIGN PATENT DOCUMENTS

| | | |
|---|---|---|
| 0018219 | 10/1980 | European Pat. Off. . |
| 1056736 | 1/1967 | United Kingdom . |

OTHER PUBLICATIONS

"Black Electroless Nickel Surface Morphologies with Extremely High Light Absorption Capacity", by Christian E. Johnson, National Bureau of Standards, Washington, D.C.; Metal Finishing, Jul. 1980; vol 78.

Literature "S-780 (Continuous Electroless Nickel Plating Solution)", by Nippon Kanigen Co., Ltd.

Literature "Sumer", by Nippon Kanigen Co., Ltd.

Literature "Electroless Nickel Plating—Kanigen Process", by Nippon Kanigen Co., Ltd.

Patents Abstract of Japan, vol. 3, No. 41 (E-103), Apr. 10, 1979, p. 55, & JP-A-54 20 746 (Tokyo Shibaura Denki K.K.) 16-02-1979 *Abstract*.

*Primary Examiner*—William A. Powell

*Attorney, Agent, or Firm*—Frishauf, Holtz, Goodman & Woodward

[57] ABSTRACT

An ultra-black film is disclosed, which essentially consists of a base, a Ni-P alloy layer formed on said base and a phosphate layer formed on said Ni-P layer, the spectral reflectance of said ultra-black film being 0.04 to 0.4%. The ultra-black film is obtainable by one of four methods, i.e., a first method, which comprises sequential steps of effecting primary etching of a Ni-P alloy film surface with an aqueous nitric acid solution and effecting secondary etching of the surface with an aqueous sulfuric-acid-containing nitrate solution, a second method, which comprises of effecting said secondary etching of a Ni-P alloy film surface a third method, which comprises sequential steps of forming a Ni-P alloy film on a base by using a plating solution basically composed of nickel salt, sodium hypophosphite, D, L-malic acid and malonic acid and effecting said secondary etching to the alloy film surface and a fourth method, which comprises sequential steps of forming a Ni-P alloy film on a base by using a plating solution basically composed of nickel salt, sodium hypophosphite, D, L-malic acid and succinic acid or basically composed of nickel salt, sodium hypophosphite, D, L-malic acid lactic acid and malonic acid and effecting said primary etching to the surface.

37 Claims, 18 Drawing Sheets

METHOD OF MANUFACTURING ULTRA-BLACK FILM

This is a division of application Ser. No. 268,509, filed Nov. 8, 1988, now U.S. Pat. No. 4,984,855.

BACKGROUND OF THE INVENTION

1. Field of the Invention

This invention relates to a film consisting of an ultra-black film formed on a base surface and a method of forming the same. The ultra-black film is formed by etching a nickel-phosphorus alloy film deposited by an electroless plating process on the base surface It has low spectral reflectance, has small wavelength dependence of the reflectance, and is effectively utilized as optical absorber.

2. Description of the Related Art

As the ultra-black film which is formed on a base surface, coating films using black paints, black oxide films, black metal compound films, black-chromatet-reated films obtained by metal plating, black chromium films, black nickel films and films obtained by impregnating porous films formed by an anodic oxidization process with black dyes are known. These ultra-black films generally have spectral reflectance of 3 to 10%. This reflectance is unsatisfactory if the films are to be used as an optical absorber for optical power measurement apparatuses or the like. As a further variety of the ultra-black film formed on a base surface, a gold black film consisting of ultramicroparticles of gold is known. This film has a spectral reflectance of approximately 0.5%, which is lower than those of black paints noted above. Hence, bases with this film are utilized as optical absorber for an optical power measurement apparatuses or the like. The film, however, has low mechanical strength, and if it is used under conditions subjected to mechanical vibrations or rubbing, it readily drops out from the base. In addition, under high humidity conditions, it absorbs moisture and increase the reflectance. Once this occurs, the initial reflectance can not be recovered when it is dried again. For the above reasons, the environments and conditions of its use are extremely limited. U.S. Pat. specifications No. 4,233,107 and 4,361,630 pertaining to inventions by C. E. Johnson Sr. disclose a method of obtaining an ultra-black film by etching a nickel-phosphorus alloy plating film with an aqueous nitric acid solution. This ultra-black film has spectral reflectance ranging from 0.5 to 1.0% and has high mechanical strength. However, the optical reflectance varies greatly with wavelength change. Therefore, this film still poses problems in its use as an optical absorber for measuring optical power with high accuracy in a wavelength range of 380 to 1,800 nm.

U.S. Pat. specification No. 4,511,614 pertaining to an invention by R. L. Greeson et al discloses an improvement over the afore-noted two United States patents. The disclosed film consists of two nickel-phosphorus alloy layers having different phosphorus contents. This film, however, requires an increased number of steps of manufacture because of a two-layer structure.

Further, the spectral reflectance of the film exceeds 0.5%.

SUMMARY OF THE INVENTION

A primary object of the invention is to provide an ultra-black film, which has low spectral reflectance and less wavelength dependency thereof compared to prior art ultra-black films, and a method of forming the same.

A second object of the invention is to provide an ultra-black film, which has high mechanical strength and hence is difficultly broken compared to the gold black film and a method of manufacturing the same.

A third object of the invention is to provide an ultra-black film, which has superior resistance against moisture to that of the gold black film and a method of forming the same.

A fourth object of the invention is to provide a method of forming an ultra-black film having excellent properties as noted above by a simple process.

To attain the above objects of the invention, there is provided an ultra-black film, which essentially consists of a base, a nickel-phosphorus alloy layer formed on said base and a phosphate film formed on said nickel-phosphorus layer, the spectral reflectance of said ultra-black film being 0.04 to 0.1% or 0.1 to 0.4% in a wavelength range of 380 to 1,800 nm, the wavelength dependency of said spectral reflectance in said wave length range being 0.1% or below. This ultra-black film is formed by the following methods.

(1) A first method comprises sequential steps of forming a nickel-phosphorus alloy film by an ordinary electroless plating process on a base, effecting primary etching of the alloy film surface with an aqueous nitric acid solution and effecting secondary etching of the surface with an aqueous sulfuric-acid-containing nitrate solution.

(2) A second method comprises sequential steps of forming a nickel-phosphorus alloy film by an ordinary electroless plating process on a base and effecting etching of the alloy film surface with aqueous sulfuric-acid-containing nitrate solution like the secondary etching steps noted above.

(3) A third method comprises sequential steps of forming a nickel-phosphorus alloy film on a base by using a plating solution basically composed of nickel salt, sodium hypophosphite D, L-malic acid or salt thereof and malonic acid or salt thereof and etching the alloy film surface with an aqueous sulfuric-acid-containing nitrate solution like the second method.

(4) A fourth method comprises sequential steps of forming a nickel-phosphorus alloy film on a base by using a plating solution basically composed of nickel salt, sodium hypophosphite D, L-malic acid or salt thereof and succinic acid or salt thereof or, basically composed of nickel salt, sodium hypophosphite D, L-malic acid or salt thereof, lactic acid or salt thereof and malonic acid or salt thereof and etching the surface with an aqueous nitric acid solution like the primary etching step in the first method.

The methods (1) and (2) permit ultra-black films to be obtained, which have spectral reflectance of 0.1 to 0.4 %. The surface of these ultra-black films has innumerable conical holes formed close to one another and having opening diameters of 1 to 6 μm. These conical holes have fluffy surfaces, which further have innumerable finer irregularities.

The method (3) permits an ultra-black film to be obtained, which has spectral reflectance of 0.1 to 0.4%, and the surface of which has innumerable ultra-fine asperities of relatively uniform height capable of observation with a scanning electron microscope.

The method (4) permits an ultra-black film to be obtained, which has spectral reflectance of 0.04 to 0.1%, and the surface of which has innumerable conical holes formed close to one another and having opening diameters of mainly 1 to 6 μm. The surfaces of these conical holes further have innumerable finer irregularities.

By either one of the above methods according to the invention, a more ideal ultra-black film than the ultra-black film obtainable by the prior art method can be obtained. Its spectral reflectance is as low as 0.04 to 0.1 or 0.1 to 0.4%. The variation range of the spectral reflectance is as low as 0.1 % or less in the same wave length range. Further, the film has mechanical vibration resistance, abrasion resistance and moisture resistance. The inventors estimate that the superior properties of the ultra-black film obtainable according to the invention is mainly attributable to the surface morphology of the film; for instance the surface morphology with innumerable conical holes ranging 1 to 6 μm in size, the conical hole surfaces being fluffy and having finer irregularities than the conical holes, in the base of the ultra-black films obtainable by the first, second and fourth methods or the surface morphology with ultra fine asperities of relatively uniform height in the case of the ultra-black film obtainable by the third method.

Figure 1:
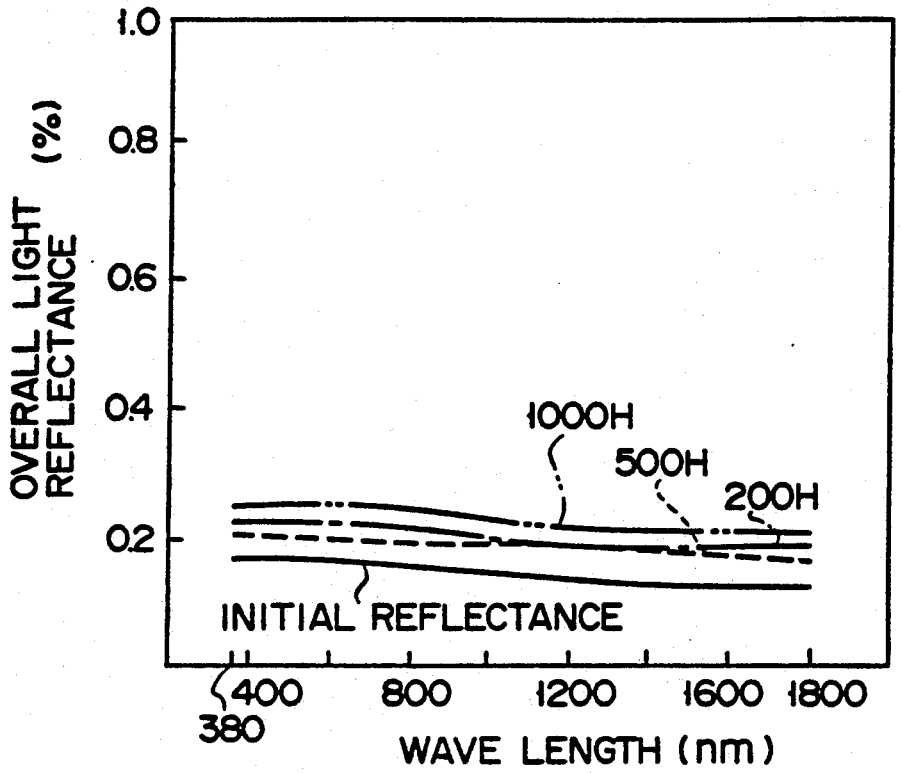
FIGS. 1 to 4 are graphs showing the spectral reflectance of ultra-black films manufactured by the first to fourth methods according to the invention.

DETAILED DESCRIPTION OF THE PREFERRED EMBODIMENTS (First Method of Forming Ultra-black Film)

First, a base, on which the ultra-black film is to be formed, is prepared. The material of the base, usually, may be metals, glass, ceramics, plastics, etc.

Then, a nickel-phosphorus alloy plating film is formed on the base. The plating film is usually formed by electroless plating. It contains 7 to 10 % by weight of phosphorus, the remainder consisting of nickel and inevitable impurities. In the plating, in the case of a base made of a metal or like electric conductor, the base is first treated with 1,1,1-trichloroethane and alkaline cleaning solution, followed by pickling with acid solution. Subsequently, nickel strike plating is performed, and the resultant base is immersed in an electroless nickel-phosphorus alloy plating solution to form the nickel-phosphorus alloy plating film on the base surface. In the case of a base made of a nonconductor, e.g., glass, ceramics and plastics, the base surface is preliminarily activated with a tin chloride solution and a palladium chloride solution, and then the nickel-phosphorus alloy film is formed by treating the base with the electroless nickel-phosphorus alloy plating solution. As the electroless nickel-phosphorus alloy plating solution may be used those which are commercially available. The base is usually held immersed in the solution at a temperature of 80 to 95° C. for 1 to 5 hours. The nickel-phosphorus alloy film has a thickness of at least 30 μm, preferably 70 to 80 μm.

Subsequently, the step of primary etching of the nickel-phosphorus alloy plating film with an aqueous nitric acid solution is performed. The concentration of nitric acid used in the primary etching step suitably ranges from 1 part of nitric acid for 2 parts of water to concentrated nitric acid. The solution temperature is 20 to 100° C., and the immersion time is 5 seconds to 5 minutes. Specifically, although depending on the phosphorus content of the film and the temperature and acid concentration of the nitric acid solution, usually by using a 1 : 1 nitric acid solution at 50° C. the nickel-phosphorus alloy film is blackened in 5 to 30 seconds.

After the primary etching step, the base is rinsed with water. Subsequently, the secondary etching of the film is performed using an aqueous sulfuric acid containing nitrate solution for blackening the film. The nitrate used in this etching step is usually sodium nitrate, and its concentration is 200 to 450 g/l, preferably 300 to 400 g/±. The concentration of sulfuric acid added is 300 to 700 g/l, preferably 400 to 600 g/l. Typical process conditions are a solution temperature of 30 to 80° C. and an immersion time of 5 seconds to 5 minutes. However, the etching conditions, i.e., concentration, bath temperature and immersion time, are selected in relation to the status of the nickel-phosphorus alloy plating film, and the selection can be readily done by one having ordinary knowledge in the art. After the etching, the base is rinsed with water and then dried. The ultra-black film thus obtained is very stable and excellent in the mechanical strength and moisture resistance. The spectral reflectance of the film is 0.1 to 0.4% in a wavelength range of 380 to 1,800 nm, and its wavelength dependency in this wave length range is as low as 0.1% or less.

(Second Method of Forming Ultra-black Film)

In this method, the step of preparing the base and step of forming the nickel-phosphorus alloy plating film on the base are the same as those in the first method, so no further description of these steps is given.

The base with the nickel-phosphorus alloy plating film formed thereon is rinsed with water and then dried. Subsequently, it is etched using an aqueous sulfuric-acid-containing nitrate solution for blacking the film. The etching is done under the same conditions as in the second etching step described before in connection with the first method, so it is no further described.

Observation of the surface of the ultra-black films obtained in the first and second methods reveals that the surface has innumerable conical holes formed close to one another and mainly 1 to 6 μm in diameter, the conical holes having surfaces, which have finer irregularities, the irregular surfaces being fluffy and capable of observation with a scanning electron microscope.

(Third Method of Forming Ultra-black Film)

The step of preparing the base is the same as in the first method, so it is not further described. In the third method, the prepared base is subjected to treatment with an electroless nickel-phosphorus alloy plating solution to form an electroless nickel-phosphorus alloy plating film on it. The plating solution used, is basically composed of nickel salt, sodium hypophosphite L-malic acid or salt thereof or malonic acid or salt thereof. More specifically, the plating solution used is basically composed of 0.11 to 0.20 M of nickel,, sulfate as nickel salt, 0.24 to 0.36 M of sodium hypophosphite as reducing agent, 0.40 to 0.80 M of D, L-malic acid or salt thereof as hydroxylic-carboxylic acid and 0.20 to 0.40 M of malonic acid or salt thereof as dicarboxylic acid, and usually the base is held immersed in the solution at 80 to 95° C. for 10 minutes to 3 hours. The conditions of the nickel-phosphorus alloy plating using this plating solution are the same as those described before in the first embodiment, so they are no further described.

The base with the nickel-phosphorus alloy plating film formed thereon is rinsed with water and then dried, and then it is subjected to an etching treatment with an aqueous sulfuric-acid-containing nitrate solution for blackening the film. The conditions of the etching treatment are the same as those of the etching treatment with the sulfuric-acid-containing nitrate solution in the first method, so they are no further described.

Observation of the surface of the ultra-black film which is obtained in the above way with a scanning electronic microscope reveals that the surface has innumerable ultrafine asperities of relatively uniform height recognizable with the electron microscope.

(Fourth Method of Forming Ultra-black Film)

The step of preparing the base is the same as in the first method, so it is no further described. In the fourth method, the nickel-phosphorus alloy plating film is formed on the prepared base using a nickel-phosphorus alloy plating solution, ,which is basically composed of nickel salt, sodium hypophosphite D, L-malic acid or salt thereof and succinic acid or salt thereof or basically, composed of nickel salt, sodium hypophosphite, D, L-malic acid or salt thereof, lactic acid or salt thereof and malonic acid or salt thereof. More specifically, the plating solution used is (1) basically composed of, for instance, 0.11 to 0.20 M of nickel sulfate as nickel salt, 0.24 to 0.36 M of sodium hypophosphite as reducing agent, 0.40 to 0.80 M of D,L-malic acid or salt thereof as hydroxylic-carboxylic acid and succinic acid or salt thereof as dicarboxylic acid or (2) basically composed of 0.11 to 0.20 M of nickel sulfate as nickel salt, 0.24 to 0.36 M of sodium hypophosphite as reducing agent, 0.2 to 0.4 M of D, L-malic acid or salt thereof as hydroxylic-carboxylic acid, 0.3 to 0.6 M of lactic acid as hydroxylic-carboxylic acid and 0.2 to 0.4 M of malonic acid or salt thereof as dicarboxylic acid, and usually the same is immersed in the solution at 80 to 95° C. for 1 to 5 hours.

The conditions of the nickel-phosphorus plating using this plating solution are the same as those described before in connection to the first method, so they are no further described.

The nickel-phosphorus alloy film thus formed is then etched with an aqueous nitric acid solution. The aqueous nitric acid solution has a concentration ranging from 1 part of nitrate for 2 parts of water to concentrated nitric acid, and the base is held immersed in the solution at a temperature of 30 to 80° C. for 10 seconds to 5 minutes. The etching conditions such as the concentration and temperature of the etching solution and etching time are selected as optimum conditions in relation to the state of the nickel-phosphorus plating film. The ultra-black film obtained on the base rinsed with water and dried after the etching is very stable and has excellent mechanical properties and moisture resistance. The spectral reflectance of the ultra-black film is 0.04 to 0.1% in a wavelength range of 380 to 1,800 nm, and its wavelength dependency in that wavelength range is as low as 0.1% or below.

Figure 23:
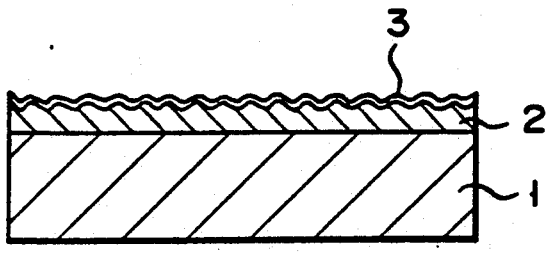
FIG. 23 is a schematic sectional view showing the structure of the ultra-black film according to the invention.

The ultra-black film which is obtainable in one of the above first to fourth methods, as shown in FIG. 23, basically consists of base 1, nickel-phosphorus alloy plating layer 2 formed on the base and phosphate layer 3 formed on the nickel-phosphorus alloy layer 2 by the acid etching The ultra-black film obtainable by any of the above methods has low spectral reflectance and small range of variation of the spectral reflectance with wavelengths compared to the ultra-black film obtainable by the well-known method. Further, it has high mechanical strength and is difficultly broken compared to the prior art gold black film/ and it is also superior to the gold black film in the moisture resistance. Further, the ultra-black film according to the invention may utilize substantially all industrial materials including metals, ceramics and plastics for the base, and it can be formed in a simple method. Thus, the ultra-black film obtainable according to the invention can find effective applications as light absorbers for apparatuses for accurately measuring absolute light intensity, terminal elements for optical transmission systems, and internal reflection prevention members in optical apparatuses.

Table 1 compares the first to fourth method of ultra-black film formation according to the invention and methods disclosed in U.S. Pat. specifications No. 4,233,107 and 4,361,630.

Now, preferred embodiments of the invention will be described. Embodiments 1 to 7 concern the first method according to the invention, Embodiments 8 to 11 concern the second method according to the invention, Embodiments 12 to 15 concern the third method of the invention, and Embodiments 16 to 18 concern the fourth method of the invention.

Embodiment 1

A base consisting of a copper disk 8 mm in diameter and 0.3 mm in thickness was subjected to a degreasing with 1,1,1-trichloroethane and alkaline clearing solution at a bath temperature of 50 to 60° C. The base was then rinsed with water and then pickled with 1 : 1 hydrochloric acid solution. Subsequently, the nickel strike electroplating on the base was performed. Thereafter, the base was held immersed in an electroless nickle-phosphorus alloy plating solution, provided under trade name "S-780" by Nippon, Kasein Co., Ltd., composed of nickel sulfate, sodium hypophosphite, hydroxylic-carboxylic acid and dicaboxylic acid at a bath temperature of 90° C. for three hours to obtain precipitation of a nickel-phosphorus alloy plating film containing 8 to 10% by weight of phosphorus to a thickness of about 70 to 80 μm on the base surface. The base with this film on it was then rinsed with water and then treated for primary etching in an 1 : 1 aqueous nitric acid solution at a bath temperature of 50° C. for 30 seconds. After the primary etching, the base was rinsed with water, and without drying it was held immersed as a secondary etching treatment in 100 ml of a solution containing 400g/l of sodium nitrate and 552g/l of sulfuric acid at a temperature of 50° C. for 30 seconds. After this treatment, the base was taken out, rinsed with water and dried.

The ultra-black film formed on the surface of the base thus obtained was very stable and excellent in resistance against mechanical vibrations, rubbing and moisture. This ultra-black film had a phosphate film of a thickness of approximately 200 angstroms.

In FIG. 1, solid curve shows the spectral reflectance of the ultra-black film obtained in the above way in a wavelength range of 380 to 1,800 nm. The spectral reflectance is lower than 0.2 % over the wavelength range, indicating that the reflectance is changed very slightly with wavelength changes. Brokenline curves in the Figure show the spectral reflectance measured after holding the ultra-black film exposed to an environment at 85° C. and with a relative humidity of 85% for 200, 500 and 1,000 hours, respectively. The spectral reflectance was measured with an integrating sphere spectral photometer. The spectral reflectance is increased slightly with the exposure noted above. It is around 0.2% in the wavelength range, indicating substantially no wavelength dependency of it.

Figure 6:
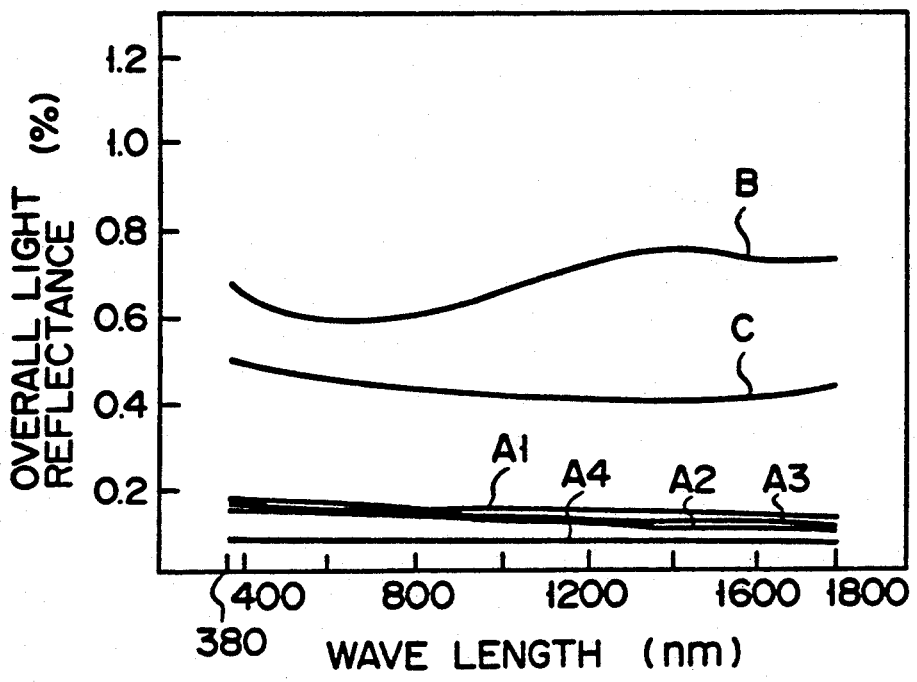
FIG. 6 is a graph showing the spectral reflectances (A1 to A4) of ultra-black films obtained by the first to fourth methods according to the invention, spectral reflectance (B) of an ultra-black film disclosed in U.S. Pat. specification No. 4,361,630 and spectral reflectance (C) of gold black.

In the graph of FIG. 6, curve Al is the same as the solid curve in FIG. 1, showing the spectral reflectance the ultra-black film according to the invention. Curve B shows the spectral reflectance of a ultra-black film obtained by the sole primary etching in the above embodiment, which corresponding to one disclosed in U.S. Pat. specification No. 4,233,107. Curve C is the spectral reflectance of a gold black film. It will be seen from the graph that the ultra-black film according to the invention has very superior spectral reflectance to those of the well-known ultra-black films.

Figure 7A:
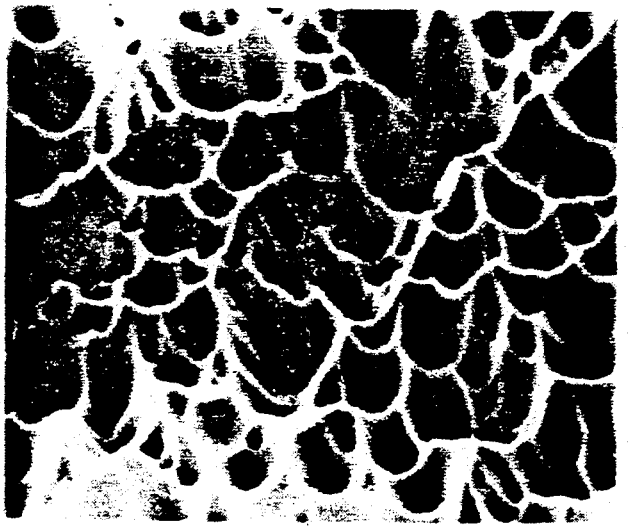
FIG. 7A is a microscopic photograph showing the result of observation of the surface morphology of an ultra-black film obtained after a primary etching treatment in the first method of the invention (without a secondary etching treatment) with a scanning electron microscope.
Figure 7B:
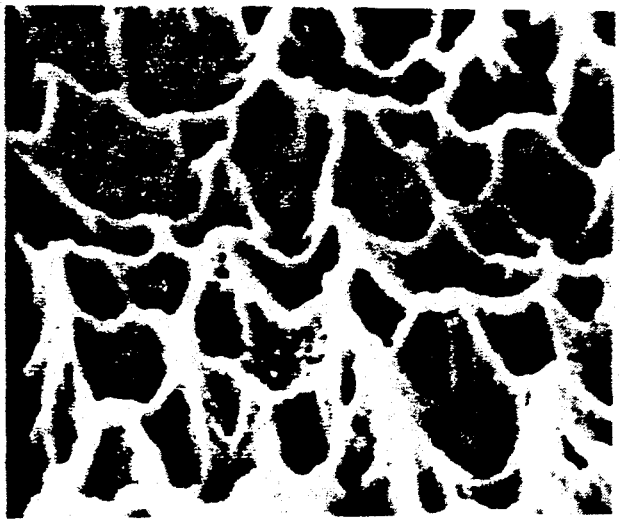
FIG. 7B is a microscopic photograph showing the result of observation of the surface morphology of an ultra-black film obtained by performing the primary and secondary etching treatments in the first method of the invention with a scanning electron microscope.
Figure 8A:
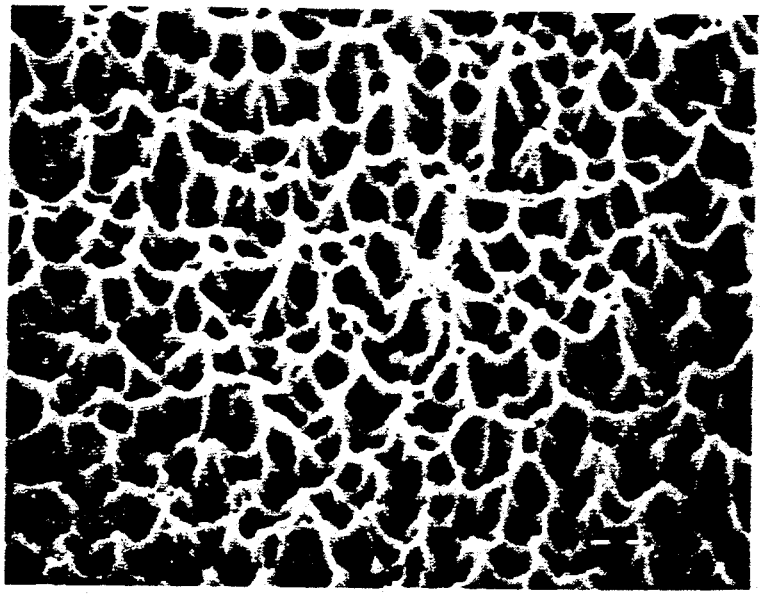
FIGS. 8A to 8D are microscopic photographs, magnified to 2,500, 5,500, 7,500 and 20,000 times, respectively, of the surface morphology of an ultra-black film formed by a second method according to the invention taken with a scanning electron microscope.
Figure 8B:
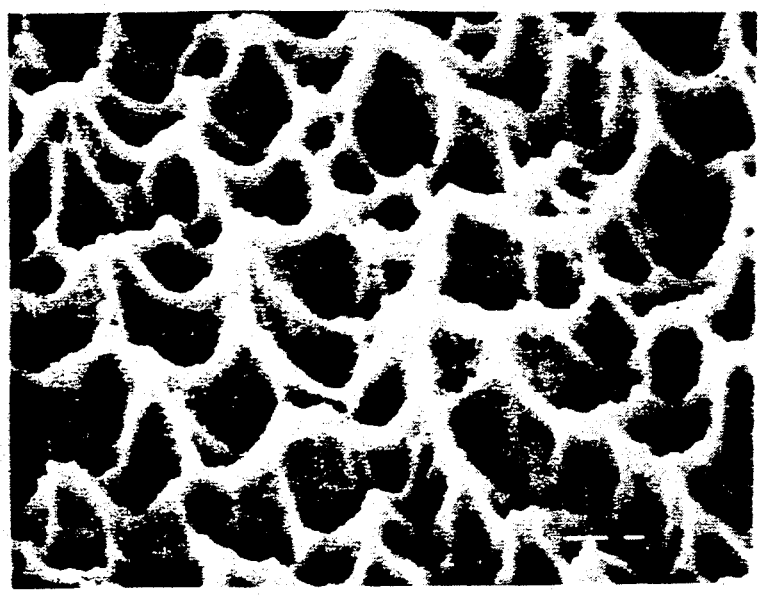
Figure 8C:
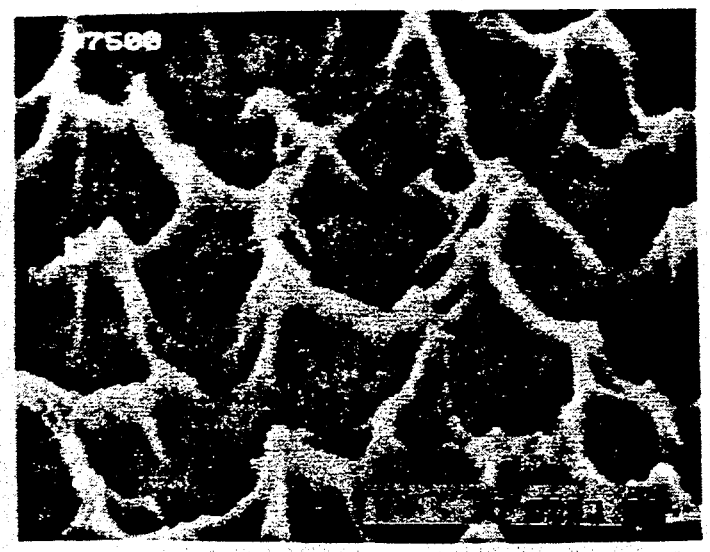
Figure 8D:
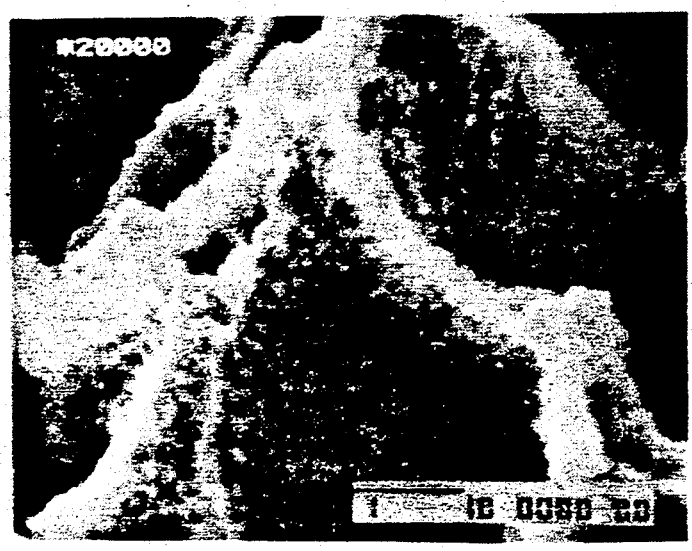
Figure 9A:
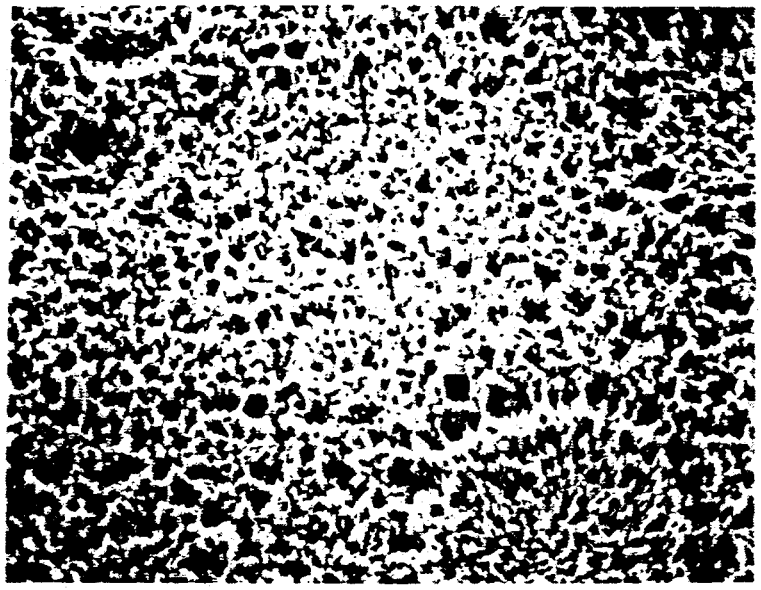
FIGS. 9A to 9D are microscopic photographs, magnified to 2,500, 5,500, 7,500 and 20,000 times, respectively, of the surface morphology of an ultra-black film formed by a third method according to the invention taken with a scanning electron microscope.
Figure 9B:
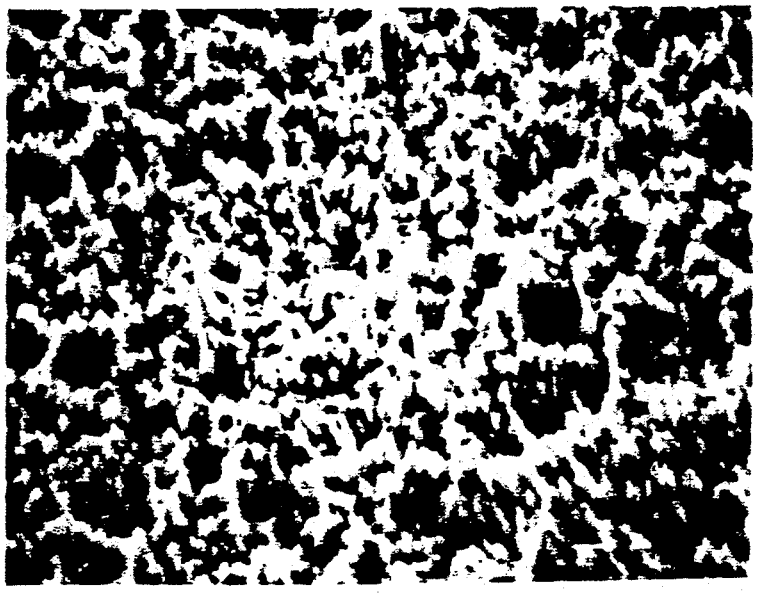
Figure 9C:
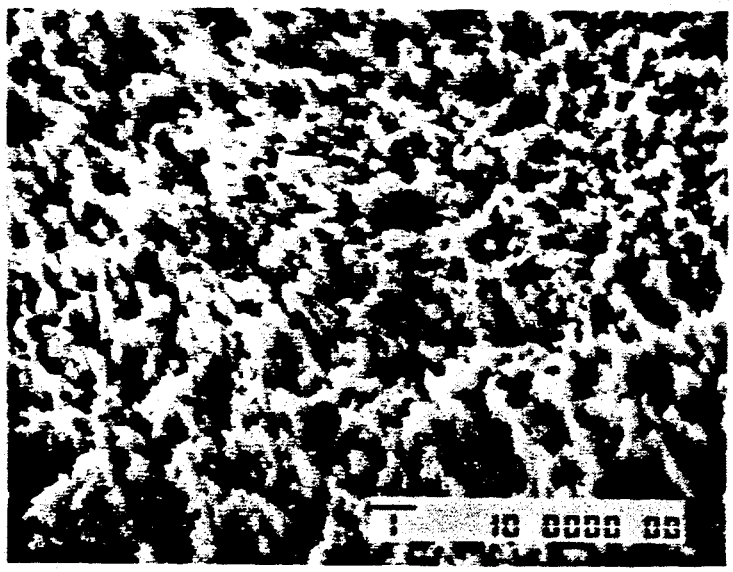
Figure 9D:
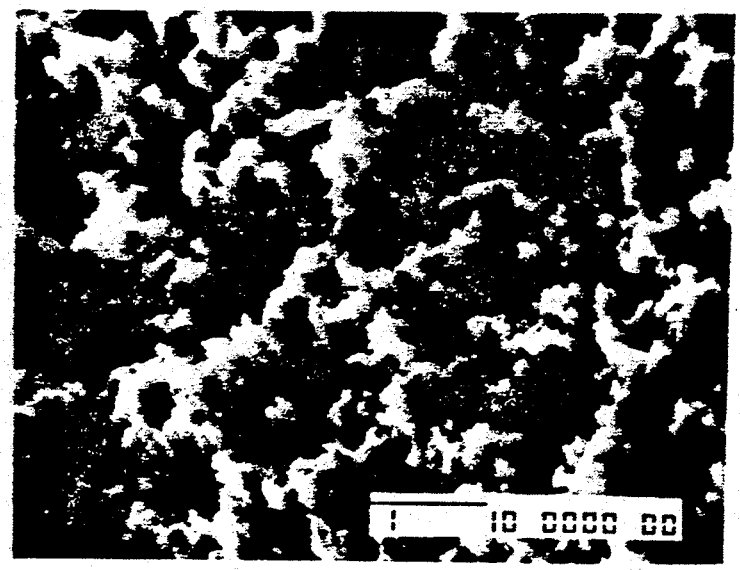
Figure 10A:
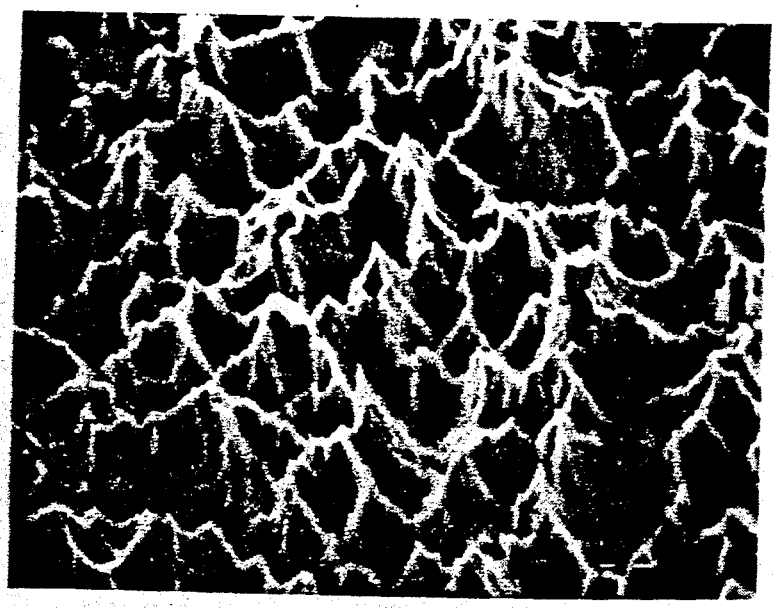
FIGS. 10A to 10D are microscopic photographs, magnified to 2,500, 5,500, 7,500 and 20,000 times, respectively, of the surface morphology of an ultra-black film formed by a fourth method according to the invention taken with a scanning electron microscope.
Figure 10B:
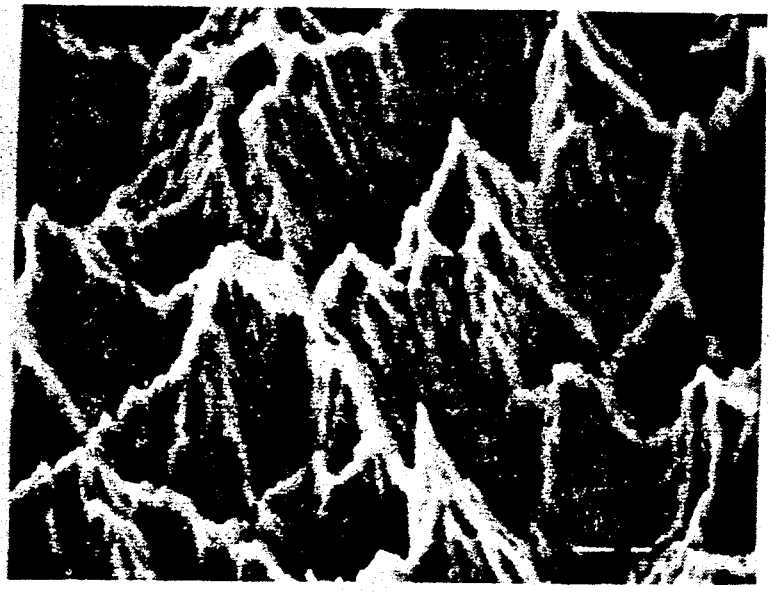
Figure 10C:
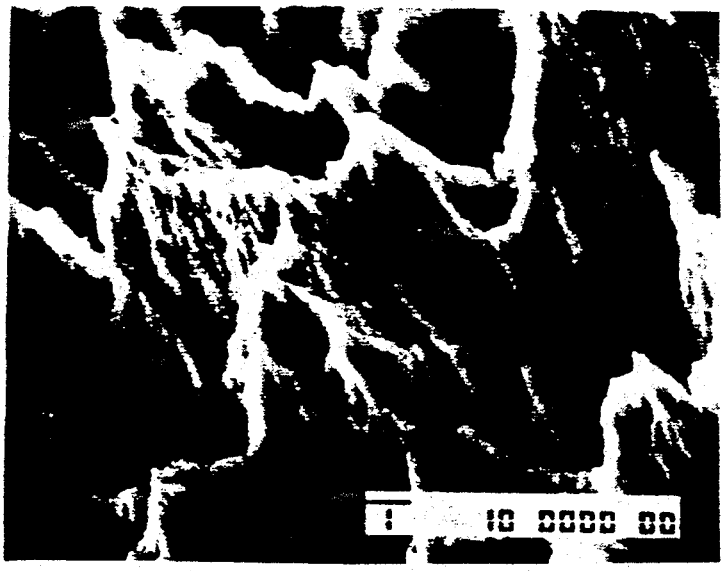
Figure 10D:
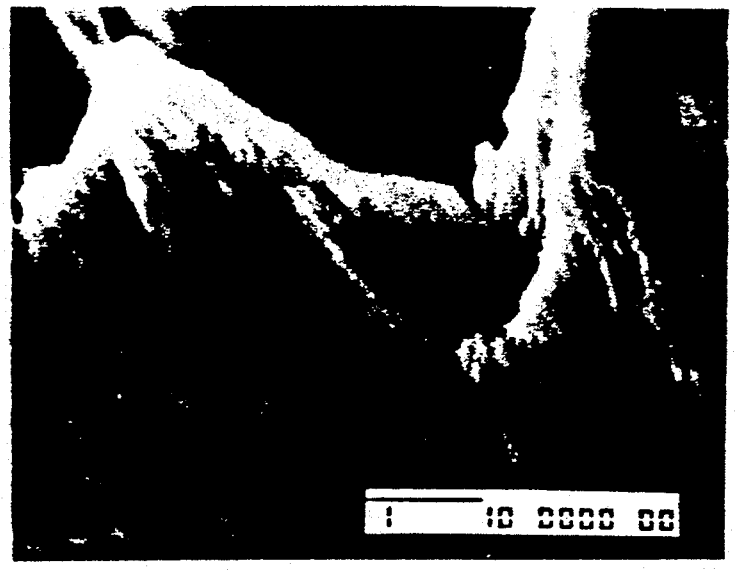
Figure 11A:
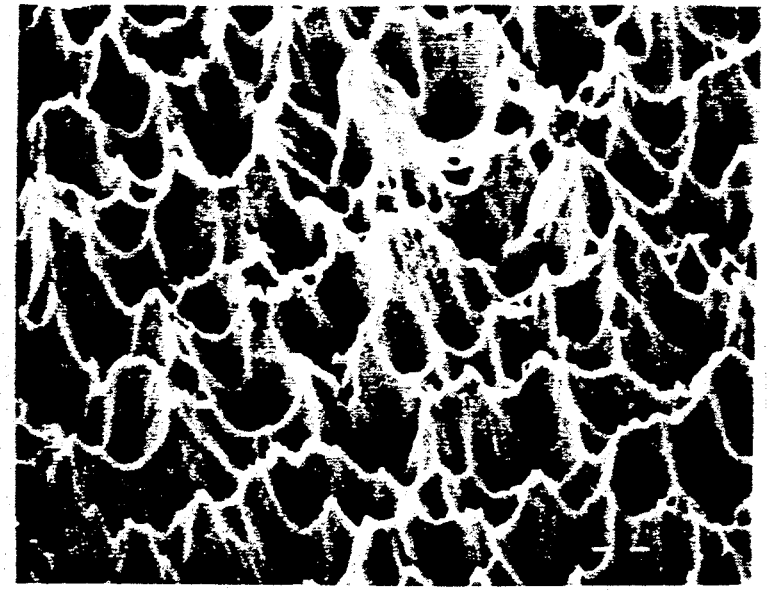
FIGS. 11A to 11D are photographs, magnified to 2,500, 5,500, 7,500 and 20,000 times, respectively, of the surface morphology of a different ultra-black film formed by the fourth method of the invention taken with a scanning electron microscope.
Figure 11B:
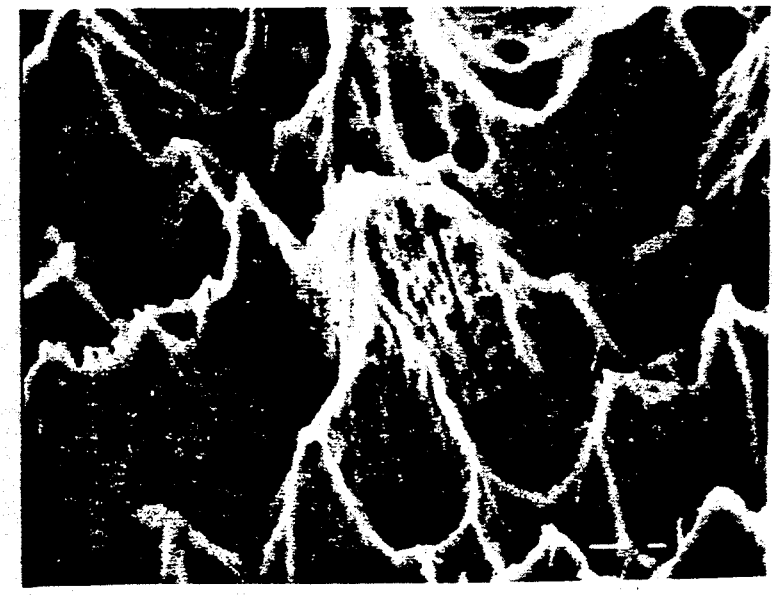
Figure 11C:
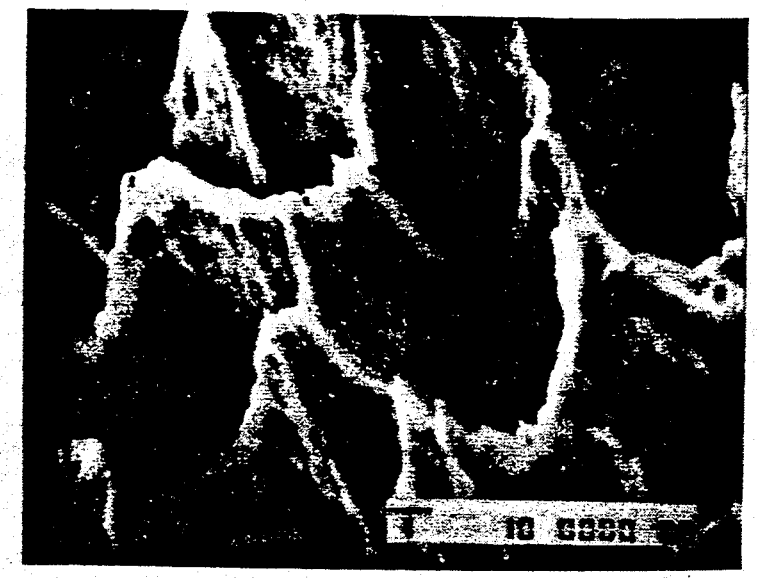
Figure 11D:
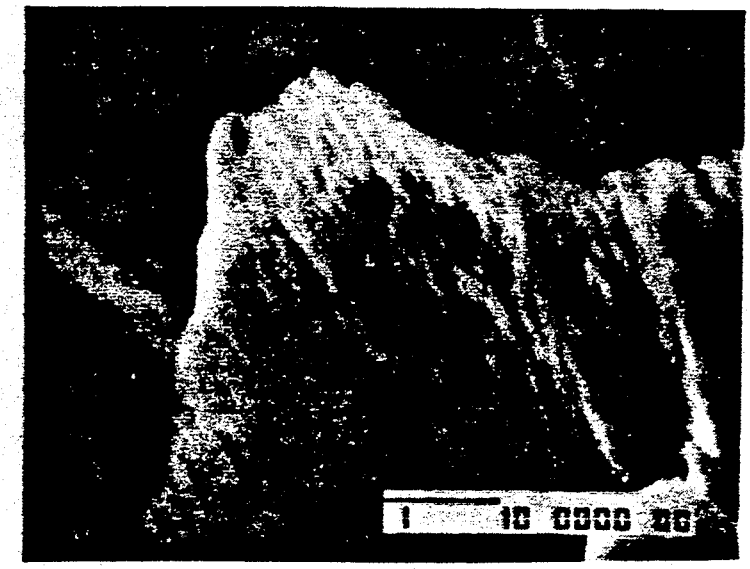
Figure 12A:
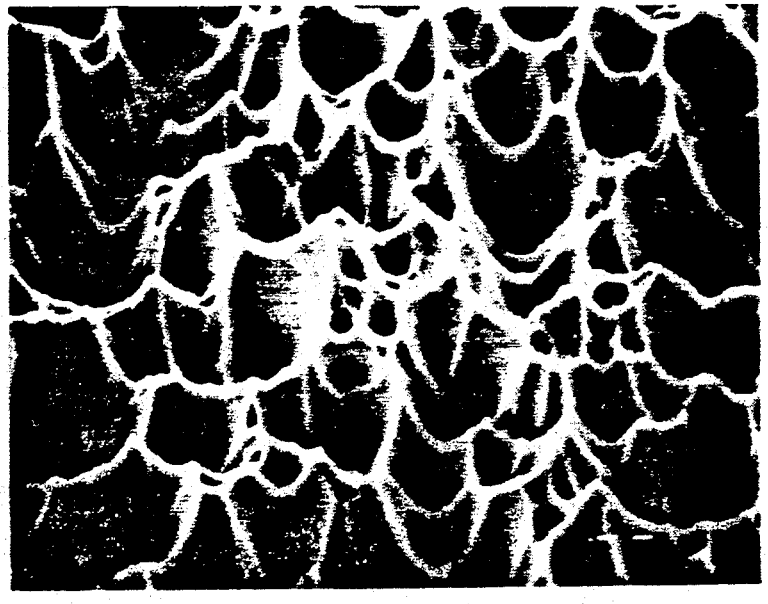
FIGS. 12A to 12D are photographs, magnified to 2,500, 5,500, 7,500 and 20,000 times, respectively, of the surface morphology of an ultra-black film manufactured by the invention on the basis of a method disclosed in United States patent specification 4,361,630 with a scanning electron microscope.
Figure 12B:
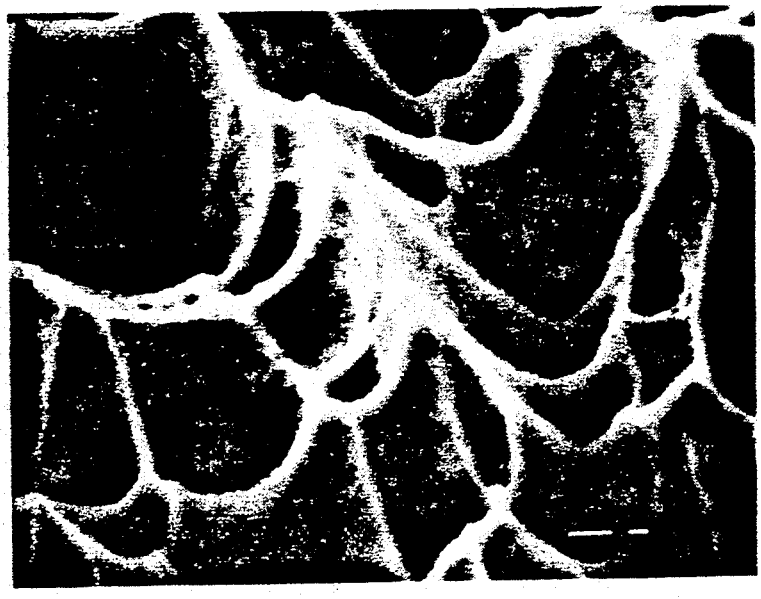
Figure 12C:
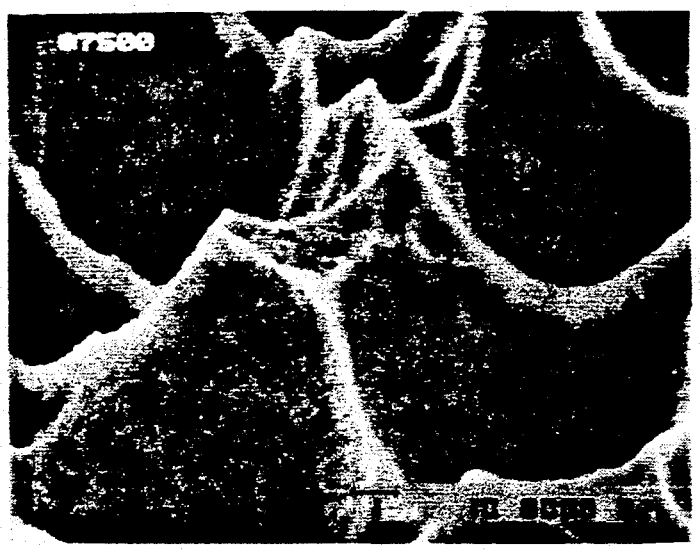
Figure 12D:
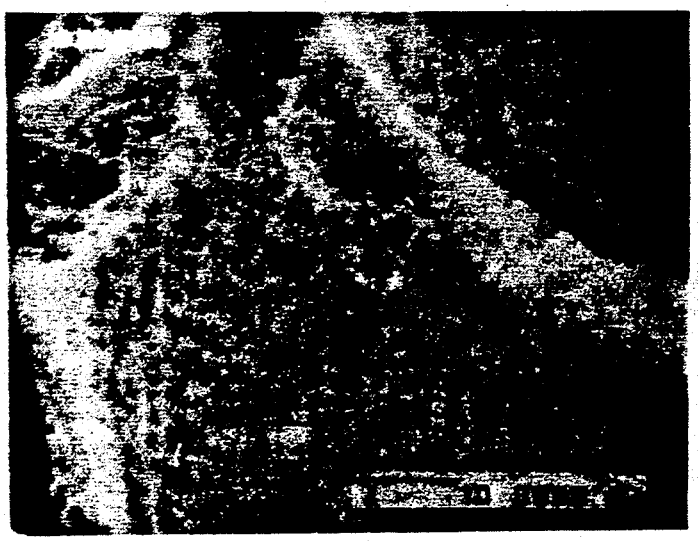

FIG. 7A shows the surface morphology, observed with a scanning electron microscope, of an ultra-black film obtained by rinsing with water and drying after the sole primary etching treatment. FIG. 7B shows the surface morphology, again observed with the scanning electron microscope, of an ultra-black film obtained after the secondary etching treatment subsequent to the primary etching treatment in accordance with the invention. From the comparison of these photographs it will be seen that the surface of the ultra-black film formed through the primary and secondary etching treatments according to the invention features ultrafine asperities of relatively uniform height formed on the surfaces of conical holes, which are also observable on the surface of the ultra-black film formed through the sole primary etching treatment. The inventors think that this feature of the surface morphology provides for the aforementioned excellent properties of the ultra-black according to the invention.

Figure 13:
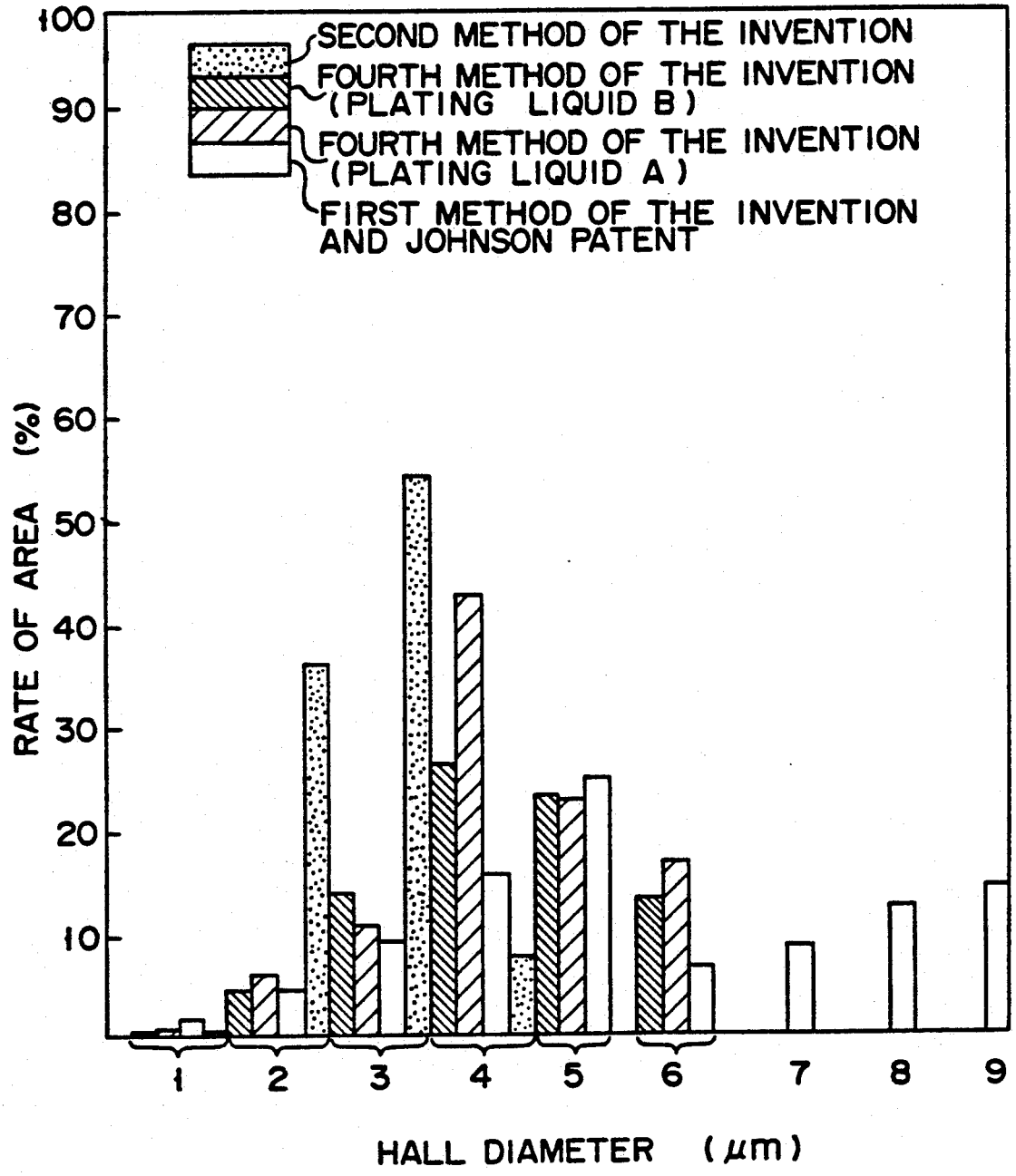
FIG. 13 is a view showing hole diameter distributions of holes present on the surfaces of the ultra-black films shown in FIG. 7B, 8 and 19 to 12.

FIG. 13 is a distribution of the diameters of the holes formed in the ultra-black film surface as shown in FIG. 7B concerning the third method of the invention. The hole diameter ranges from 1 to 9 μm.

Embodiments 2 to 6

Ultra-black films were obtained in the same manner as Embodiment 1 except for that the concentrations of sodium nitrate and sulfuric acid in the aqueous solution used for the secondary etching treatment were varied as follows.

| | $NaNO_3$ | $H_2SO_4$ |
|---|---|---|
| Embodiment 2 | 200 g/l | 442 g/l |
| Embodiment 3 | 300 g/l | 442 g/l |
| Embodiment 4 | 400 g/l | 443 g/l |
| Embodiment 5 | 200 g/l | 552 g/l |
| Embodiment 6 | 300 g/l | 552 g/l |

Figure 5:
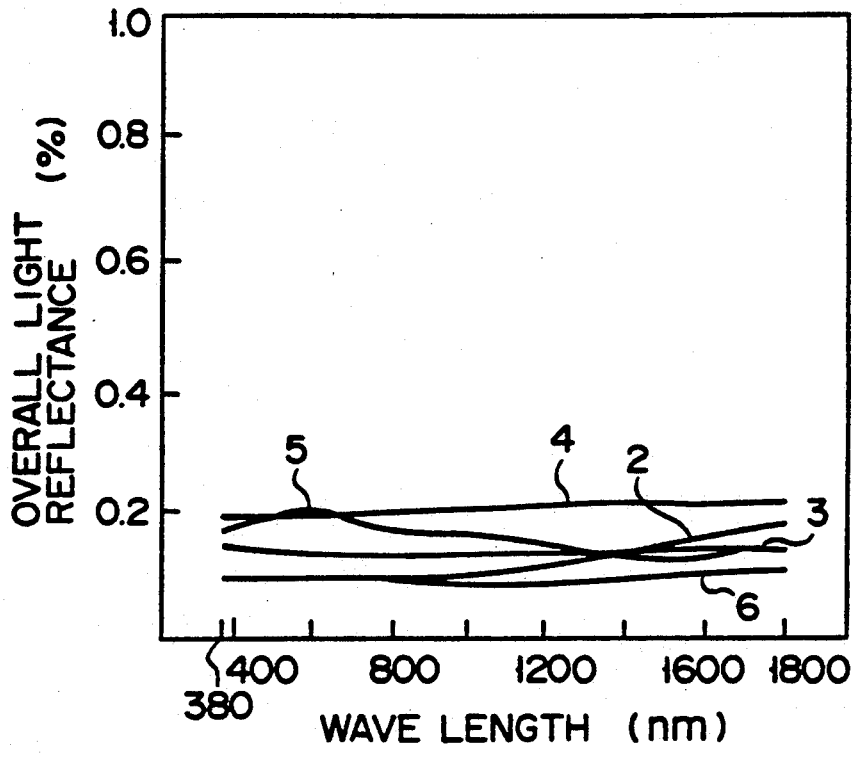
FIG. 5 is a graph showing measurements of the spectral reflectance of ultra-black films obtained in Embodiments 2 to 6 concerning the first method according to the invention.

FIG. 5 shows measurements of the spectral reflectance of these ultra-black films. In the Figure, symbols 2 to 6 represent Embodiments 2 to 6, respectively.

It will be seen that with the ultra-black films obtained in Embodiments 2 to 6, the spectral reflectance and variation range thereof are as excellent as those obtained in Embodiment 1.

Embodiment 7

This embodiment concerns a method, in which the etching treatment disclosed in U.S. Pat. specification No. 4,233,107 was performed as primary etching treatment prior to the secondary etching treatment according to the invention, thus obtaining a ultra-black film.

More specifically, a base consisting of a copper disk 8 mm in diameter and 0.3 mm in thickness was subjected to a degreasing using an alkaline cleaning solution at a bath temperature of 50 to 60° C. The base was then rinsed with water and then pickled with 1 : 1 hydrochloric acid solution. Subsequently, nickel strike electron plating was performed, and then a nickel-phosphorus alloy plating film was precipitated to a thickness of 70 to 80 μm using an electroless nickel-phosphorus alloy plating solution at a bath temperature of 90° C.

The copper base with the nickel-phosphorus alloy plating film thus formed thereon was rinsed with water and then held immersed, as primary etching treatment, in 1 : 1 aqueous nitric acid solution at a bath temperature of 50° C. for 30 seconds. After the primary etching treatment, the base was rinsed with water, and without drying it was then held immersed, as secondary etching treatment, in 100 ml of an aqueous solution containing 400 g/l of sodium nitrate and 552 g/l of sulfuric acid. After the treatment, the base was taken out, rinsed with water and dried. With the ultra-black film thus obtained, the surface morphology, optical absorption characteristic and various other characteristics were similar to those of the ultra-black film obtained in Embodiment 1.

Embodiment 8

A nickel-phosphorus alloy film was formed on the surface of a copper base under the same conditions as in Embodiment 1.

The base with the nickel-phosphorus alloy plating film formed thereon was then rinsed with water, and it was then subjected to an etching treatment for blackening. The treatment was done with a solution containing 300 g/l of sodium nitrate and 552 g/l of sulfuric acid, at a temperature of 50° C. and for a period of 60 seconds. After the treatment, the base was rinsed with water and then dried, thus obtaining a ultra-black film according to the invention formed on the base.

Figure 2:
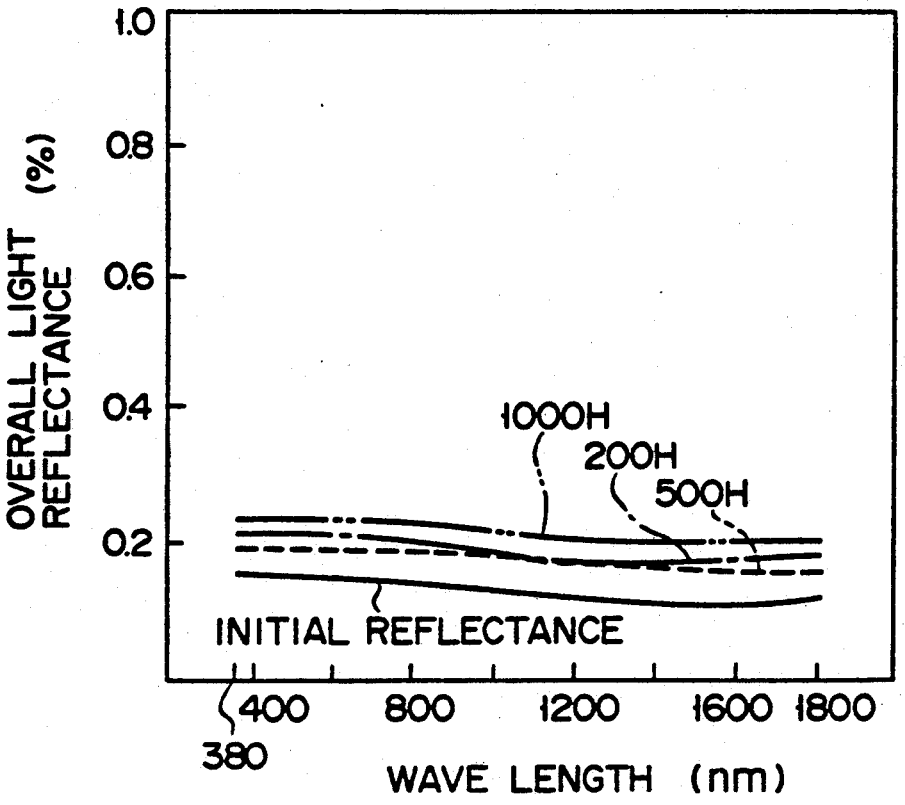

In FIG. 2, solid curve shows the spectral reflectance, measured with an integrating sphere spectral photometer, of the ultra-black film obtained in the above way in a wavelength range of 380 to 1,800 nm. The spectral reflectance is lower than 0.2%, and its variation range with wavelength-dependency is vary small, namely less than 0.1%. Broken-line curves in the Figure show the spectral reflectance measured after holding the ultra-black film exposed to an environment at 85° C. and with a relative humidity of 85 % for 200, 500 and 1,000 hours, respectively. These spectral reflectance values are slightly increased over that shown by the solid curve and are around 0.2%. The wavelength-dependency of the spectral reflectance is substantially the same as that prior to the exposure noted above.

The graph of FIG. 6 compares the spectral reflectance of the ultra-black film according to the invention (shown by curve A2), that of the ultra-black film disclosed in U.S. Pat. specification No. 4,361,630 (shown by curve B) and that of the gold black film (shown by curve C) in a wavelength range of 380 to 1,800 nm. It will be seen that the ultra-black film according to the invention has very low spectral reflectance and very slight wavelength dependency of the spectral reflectance compared to the cases of curves B and C.

FIGS. 8A to 8D show photographs of the surface of the ultra-black film formed on the base surface in Embodiment 1, observed with a scanning electronic microscope. The magnification is increased in the order of photographs A to D, and its rough idea may be had from the scale provided in a lower portion of each photograph. From photograph 8A will be seen that the ultra-black film surface has conical holes randomly distributed over the entire surface. From photographs 8B and 8C it will be seen that fine irregularities are formed in the surfaces of conical holes. From photographs 8B to 8D, particularly from photograph 8D, it can be seen that the conical holes shown have fluffy surfaces.

FIGS. 12A to 12D show photographs, taken with a scanning electron microscope, of the surface of an ultra-black film formed by the invention on the basis of the method disclosed in U.S. Pat. specification No. 4,361,630. Like FIGS. 8A to 8D, the magnification is increased in the order of photographs 12A to 12D, and its rough idea may be had from the scale provided in a lower portion of each photograph. From photograph 12A it will be seen that the ultra-black surface has conical holes distributed over the entire surface and having various diameters. Compared to the case of FIG. 8A, there are seen many holes having greater diameters, and the diameter distribution is comparatively non-uniform compared to the case of the invention. From photographs 12B and 12C it will be seen that fine irregularities are formed in the surfaces of fine conical holes. However, such fine irregularities occur less frequently compared to the cases of photographs 8B and 8C. From photographs 12B to 12D, particularly from photograph 12D, it will be seen that the surfaces of the conical holes are smooth compared to the case of the ultra-black film according to the invention, and no fluffy surface like those according to the invention is recognized. The inventors think that such a morphological difference, particularly the fluffy surfaces of conical holes, has an effect of enhancing the optical absorption characteristics. Further, the inventors estimate that by using nitrate for the etching treatment the attach to the nickel-phosphorus alloy surface is comparatively alleviated compared to the case of using nitric acid and that this is attributable to the formation of the aforementioned surface morphology.

FIG. 13 shows the hole diameter distribution of the ultra-black film surface of FIGS. 8A to 8D obtained by the second method and that of the ultra-black film surface of FIGS. 12A to 12D. From the graph it will be seen that according to the invention the hole diameter is comparatively uniform, ranging from 1 to 6 μm, but in the case of FIGS. 12A to 12D the hole diameter distribution covers a wider range.

Bases with ultra-black films were produced in accordance with the invention by using iron, nickel and cobalt as the material of the base in lieu of copper in the case of Embodiment 9. Each base was treated with 1,1,1-trichloroethane for degreasing and then held immersed, as cleaning, in an alkaline cleaning solution (at a bath temperature of 50 to 60° C.) for 3 to 5 minutes. The base was then rinsed with water and then subjected to electroless degreasing at ordinary temperature for one to two minutes. Subsequently, the base was rinsed with water, then pickled with 1 : 1 hydrochloric acid solution and then rinsed with water. Subsequently, the base was held immersed in an electroless nickel-phosphorus alloy plating solution at a bath temperature of 90° C. for three hours, thus obtaining precipitation of a nickel-phosphorus alloy plating film to 70 to 80 μm on the substrate surface. This film was subjected for blackening in an etching treatment in the manner as disclosed in Embodiment 9. With the ultra-black film obtained in this way the surface morphology, optical absorbance and other characteristics were similar to those in case of using the copper base.

Aluminum was used for the base. The base was treated with 1,1,1-trichloroethane for degreasing. It was then subjected to an etching treatment with a sodium hydroxide solution at ordinary temperature for 3 to 5 minutes. It was then rinsed with water and then held immersed in a blend solution containing nitric acid and hydrofluoric acid at ordinary temperature for 15 to 20 seconds to remove smut formed on the aluminum surface. The base was then rinsed with water, and then zinc substitution was done. The base was then rinsed with water, and then copper strike, nickel strike plating was done. Subsequently, the base was held immersed in an electroless nickel-phosphorus alloy plating solution at a bath temperature of 90° C. for three hours, thus obtaining precipitation of a nickel-phosphorus alloy plating film to 70 to 80 μm on the substrate surface. This film was subjected for blackening in an etching treatment in the manner as disclosed in Embodiment 9. With the ultra-black film obtained in this way, the surface structure, optical absorbance and other characteristics were similar to those in case of using the copper base.

Further, bases made of brass, bronze, cupronickel, phosphor bronze, stainless steel, eighteen gold, etc. were subjected to the same treatment process on the copper base as described above to cause precipitation of a nickel-phosphorus alloy plating cover to a thickness of 70 to 80 μm on the substrate. This film was subjected for blackening in an etching treatment in the manner as disclosed in Embodiment 9. With the ultra-black film obtained in this way, the surface structure, optical absorbance and other characteristics were similar to those in case of using the copper base.

Embodiment 9

Bases made of ceramics and glass were prepared. Since each base was an electric non-conductor, its surface was metallized or activated. For the metallization, first nichrome was deposited by the vacuum deposition process. Then, gold was deposited by the vacuum deposition process, followed by nickel strike plating, thus obtaining metallization of the base surface. For the activation, the base was immersed in a colloidal palladium suspension, or immersed a tin chloride solution and then in a palladium chloride solution to chemically reduce and activate the base surface. The metallized or activated base was held immersed in an electroless nickel-phosphorus alloy plating solution at a bath temperature of 90° C. for three hours, thus obtaining precipitation of a nickel-phosphorus alloy plating film to 70 to 80 μm on the substrate surface. This film was subjected for blackening in an etching treatment in the manner as disclosed in Embodiment 9. With the ultra-black film obtained in this way, the surface morphology, optical absorbance and other characteristics were similar to those in case of using the copper base.

Embodiment 10

A plastic base was prepared. Since the base was an electric non-conductor, its surface was metallized by forming a gold film by a cathode spattering process. Subsequently, the base was immersed in a colloidal palladium suspension, or immersed in a tin chloride solution and then in a palladium chloride solution to chemically reduce and activate the base surface. The metallized or activated base was held immersed in an electroless nickel-phosphorus alloy plating solution at a bath temperature of 90° C. for three hours, thus obtaining precipitation of a nickel-phosphorus alloy plating film to 70 to 80μm on the substrate surface. This film was subjected for blackening in an etching treatment in the manner as disclosed in Embodiment 9. With the ultra-black film obtained in this way, the surface morphology, optical absorbance and other characteristics were similar to those in case of using copper base.

Embodiment 11

In this embodiment, an electroless nickel-phosphorus film was formed on the copper base the same manner as in Embodiment 9. The film was etched by using an aqueous solution containing 360 g/l of potassium nitrate and 552 g/l of sulfuric acid in lieu of the etching solution used in Embodiment 9. With the ultra-black film obtained in this way, the surface morphology, optical absorbance and other characteristics were similar to those in the case of using the copper substrate.

Embodiment 12

In this embodiment, the base used was made of a metal, typically copper.

A copper base 8 mm in diameter and 0.3 mm in thickness was degreased with 1,1,1-trichloroethane and alkaline cleaning solution. Then, it was rinsed with water and then pickled with 1 : 1 hydrochloric acid solution, followed by nickel strike plating. Subsequently, the base was held immersed in an electro less nickel-phosphorus alloy plating solution, composed of 0.1 M of nickel sulfate, 0.3 M of sodium hypophosphite 0.5 M of D, L-malic acid and 0.3 M of malonic acid, for ultra-black film at a bath temperature of 90° C for two hours, thus causing precipitation of a nickel-phosphorus alloy plating film to a thickness of 50 μm on the base surface. The base with the nickel-phosphorus alloy film formed thereon in the above way was rinsed with water. For blackening this alloy film, an etching treatment on the film was performed with a solution containing 300 g/l of sodium nitrate and 552 g/l of sulfuric acid at 50° C. for two minutes, followed by rinsing with water and drying. The ultra-black film formed on the copper base was very stable and excellent in the resistance against mechanical vibrations, rubbing and moisture.

Figure 3:
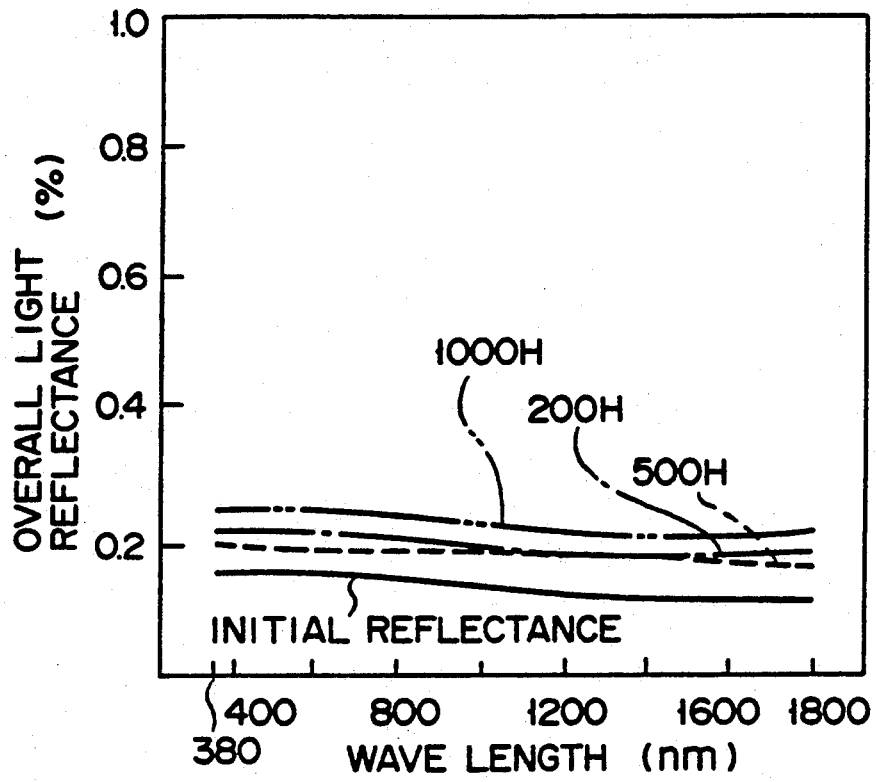

FIG. 3 shows the spectral reflectance of the ultra-black film obtained in this way for a wavelength range of 380 to 1,800 nm as measured with an integrating sphere spectral photometer. The solid curve shows the measured spectral reflectance over a wavelength range of 380 to 1,800 nm. It is as low as 0.13 to 0.17%, and it varies very slightly with wavelengths. Broken-line curves show the spectral reflectance after exposure of the film to an environment at 85° C. and with a relative humidity of 85% for 200, 500 and 1,000 hours, respectively. The spectral reflectance is around 0.2% in the wavelength range. Its wavelength dependency is the same as that before the exposure, indicating that the ultra-black film obtained according to the invention is excellent ultra-black over the wavelength range of 380 to 1,800 nm.

In FIG. 6, curve A3 represents the spectral reflectance of the ultra-black film obtained in this embodiment, and curve B represents the spectral reflectance of the ultra-black film disclosed in U.S. Pat. specifications No. 4,233,107 and 4,361,630. The spectral reflectance, compared to the film of curve A, is 0.5 to 1.0% and has wavelength dependency. Curve C represents the spectral reflectance of the gold black film. In this way, the ultra-black film according to the invention is far superior in the spectral reflectance to the prior art ultra-black film.

FIGS. 9A to 9D are photographs of the base with the ultra-black film formed in Embodiment 13, obtained with a scanning electron microscope. The magnification is increased in the order of photographs A to D, and its rough idea may be had from the scale shown in a lower portion of each photograph.

The ultra-black film surface shown in photograph A has ultrafine asperities of relatively uniform height formed over the entire surface.

As the magnification is increased progressively to photographs B to D, it will be seen that the surface has a fluffy morphology like the surface of a mohair cloth surface. In contrast to the film surface of FIGS. 12A to 12D, which has conical holes, the film surface of FIGS. 9A to 9D have ultrafine asperities of relatively uniform height, which are observed to be of a fluffy more like that of a mohair cloth surface. In other words, the ultra-black film formed by the third method of the invention has a feature in the surface morphology consisting of ultra-fine asperities. It can be estimated that this morphology has an effect of enhancing the optical absorbance.

It can be estimated that this ultra-fine surface morphology is formed due to alleviation of the attack on the nickel-phosphorus alloy surface owing to the use of the sulfuric-acid-containing aqueous nitrate solution in lieu of nitric acid as the etching solution.

Bases made of iron, nickel and cobalt were also treated with 1,1,1-trichloroethane for degreasing, and then treated with alkaline cleaning solution and then rinsed with water. Subsequently, electroless degreasing was performed at ordinary temperature for one to two minutes, followed by rinsing with water, then pickling with 1 : 1 hydrochloric acid solution and then rinsing with water. Each base was then held immersed in an electroless nickel-phosphorus alloy plating solution at a bath temperature of 90° C. for three hours, thus obtaining precipitation of a nickel-phosphorus alloy plating film to 70 to 80 μm on the substrate surface. This film was subjected for blackening in an etching treatment in the manner as disclosed in the third method. With the ultra-black film obtained in this way, the surface morphology, optical absorbance and other characteristics were similar to those in case of using the copper base.

Further, a base made of aluminum as metal was treated with 1,1,1-trichloroethane for degreasing, followed by etching with a sodium hydroxide solution at ordinary temperature for three to five minutes. The base was then rinsed with water and then held immersed in a blend solution containing nitric acid and hydrofluoric acid at ordinary temperature for 15 to 20 seconds for removal of smut formed on the aluminum surface. The base was then rinsed with water, and zinc substitution was performed. Then, it was rinsed with water, and copper strike, nickel strike plating was performed. The base was then held immersed in an electroless nickel-phosphorus alloy plating solution at a bath temperature of 90° C for three hours, thus obtaining precipitation of a nickel-phosphorus alloy plating film to 50 μm on the substrate surface. This film was subjected for blackening in an etching treatment in the manner as disclosed in the third method. With the ultra-black film obtained in this way, the surface morphology, optical absorbance and other characteristics were similar to those in case of the copper base.

Further, bases which were prepared from brass, bronze, cupronickel, phosphor bronze, stainless steel, eighteen gold, etc., were subjected to the same treatment as for the copper base to cause precipitation of a nickel-phosphorus alloy film for ultra-black film to a thickness of 50 μm on the base surface, followed by an etching treatment for blackening as disclosed above. With the ultra-black films thus obtained, the surface morphology, optical absorbance and other properties were similar to those of the ultra-black film obtained with the copper base.

Embodiment 13

In this embodiment, ceramic and glass bases were prepared. Since ceramics and glass are electric nonconductors, the base surface was metallized by depositing nichrome by a vacuum deposition process, then depositing gold by the vacuum deposition process and then performing nickel strike plating. Alternatively, the ceramic and glass surfaces may be activated by a chemically reducing process of immersing the bases in a colloidal palladium suspension, or immersing the bases in a tin chloride solution and then in a palladium chloride solution. The ceramic and glass bases with their surface metallized or activated were held immersed in an electroless nickel-phosphorus alloy plating solution, composed of 0.1 M. of nickel sulfate, 0.5 M of sodium hypophoshite 0.6 M of D, L-malic acid and 0.3 M of malonic acid, for ultra-black film at a bath temperature of 90° C. for one hour, thus causing precipitation of a nickel-phosphorus alloy plating film to a thickness of about 30 μm on the base surface. Then, the bases were subjected to an etching treatment with a solution containing 400 g/l of sodium nitrate and 460 g/l of sulfuric acid at 50° C. for two minutes for the blackening of the alloy film. With the ultra-black films thus obtained, the surface morphology, light reflectance and various other properties were similar to those obtained in Embodiment 13, and no particular difference could be recognized.

Embodiment 14

In this embodiment, a plastic base was prepared. Since plastics are electric non-conductors, the base surface was metallized by a cathode spattering process. Alternatively, the plastic surface may be activated by a chemically reducing process of immersing the bases in a colloidal palladium suspension, or immersing the bases in a tin chloride solution and then in a palladium chloride solution. The plastic base with its surface metallized or activated was held immersed in an electroless nickel-phosphorus alloy plating solution composed of 0.1 M of nickel sulfate, 0.5 M of sodium hypophosphite 0.6 M of D, L-malic acid and 0.3 M of malonic acid for blacking film at a bath temperature of 90° C. for 30 minutes, thus causing precipitation of a nickel-phosphorus alloy plating film to a thickness of about 18 μm on the plastic base surface. Then, the bases were subjected to an etching treatment with a solution containing 400 g/l of sodium nitrate and 460 g/l of sulfuric acid at 50° C. for 1.5 minutes for the blackening of the alloy film. With the ultra-black film thus obtained, the surface morphology, reflectance and various other properties were the same as those obtained in Embodiment 12, and no particular difference could be recognized.

Embodiment 15

In this embodiment, after an alloy film was formed on a base by the method in Embodiment 13, the alloy film was blackened by an etching treatment conducted with a solution containing 360 g/l of potassium nitrate and 552 g/l of sulfuric acid at 50° C. for two minutes. With the ultra-black film thus obtained after the etching process, the surface morphology, reflectance and various other properties were the same as those obtained in Embodiment 12.

Embodiment 16

In this embodiment, the base used was made of a metal, typically copper.

More specifically, copper bases 8 mm in diameter and 0.3 mm in thickness were treated with 1,1,1-trichloroethane and alkaline cleaning solution. Then, they were rinsed with water and then pickled with 1 : 1 hydrochloric acid solution, followed by nickel strike plating. Subsequently, the base was held immersed in an electroless nickel-phosphorus alloy plating solution A or B, (A; composed of 0.1 M of nickel sulfate, 0.25 M of sodium hypophosphite, 0.2 M of D, L-malic acid, 0.4 M of lactic acid and 0.25 M of malonic acid, B; composed of 0.1 M of nickel sulfate, 0.25 M of sodium hypophosphite, 0.4 M of D, L-malic acid and 0.45 M of succinic acid) at a bath temperature of 90° C. for three hours, thus causing precipitation of a nickel-phosphorus alloy plating film to a thickness of 70 to 80 μm on the base surface. For blackening this alloy film, an etching treatment on the film was performed with 1 : 1 aqueous nitric acid solution at a bath temperature of 50° C. for one minute, followed by rinsing with water and drying.

The ultra-black film formed on the copper base surface was very stable and excellent in the resistance against mechanical vibrations, rubbing and moisture.

Figure 4:
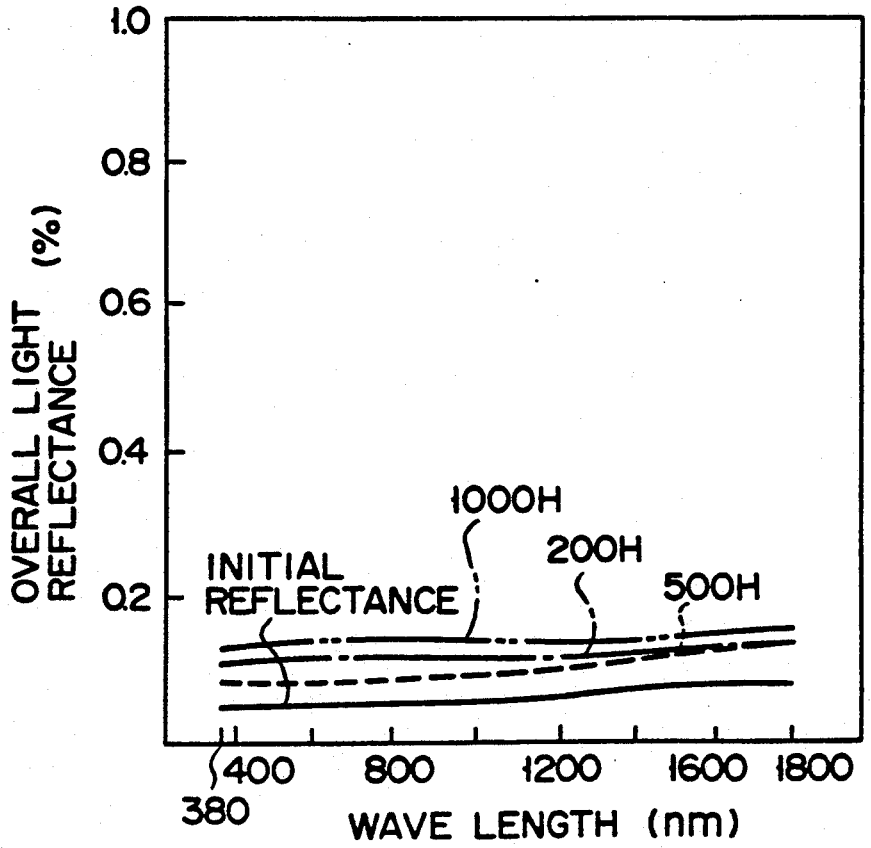

FIG. 4 shows the spectral reflectance of the ultra-black film obtained in this way for a wavelength range of 380 to 1,800 nm as measured with an integrating sphere spectral photometer. The solid curve shows the measured spectral reflectance over a wavelength range of 380 to 1,800 nm. It is as low as 0.05 to 0.08%, and it varies very slightly with wavelengths. Broken-line curves show the spectral reflectance after exposure of the film to an environment at 85° C. and with a relative humidity of 85% for 200, 500 and 1,000 hours, respectively. The spectral reflectance is around 0.1% in the wavelength range. Its wavelength dependency is hardly recognized, indicating that the ultra-black film obtained according to the invention is excellent ultra-black film over the wavelength range of 380 to 1,800 nm.

In FIG. 6, curve A4 represents the spectral reflectance of the ultra-black film obtained in this embodiment, and curve B represents the spectral reflectance of the ultra-black film disclosed in U.S. Pat. specification No. 4,233,107 and 4,361,630. The specral reflectance, compared to the film is 0.5 to 1.0% and has wavelength dependency. Curve C represents the spectral reflectance of the gold black film. The ultra-black film according to the invention thus is far superior in the spectral reflectance to the prior art ultra-black film.

FIGS. 10A to 10D are photographs of the base with the ultra-black film formed in Embodiment 16 using the plating solution A, obtained with a scanning electron microscope. The magnification is increased in the order of photographs A to D, and its rough idea may be had from the scale shown in a lower portion of each photograph.

As is seen from photograph 10A, the surface has fine conical holes distributed randomly over the entire surface. The holes are comparatively uniform in the diameter. FIG. 13 shows an example of the hole diameter distribution. It will be seen from the Figure that the holes in case of Embodiment 16 have opening diameters of mainly 1 to 6 μm while those in case of Embodiment 12 have diameters distributed in a wide range. With increasing magnification of FIGS. 10A to 10D from FIG. 10B to FIG. 10D it will be seen that the surfaces of the fine holes have finer irregularities. In other words, the ultra-black film formed by the method according to the invention has a feature in the surface morphology in that the surfaces of the fine holes have finer irregularities. A similar feature in the surface morphology can be recognized from FIGS. 11A to 11D, which are photographs of the ultra-black film formed in Embodiment 17 using the plating solution B.

By comparing the photographs of FIGS. 10A to 10D and 11 to 11D and those of FIGS. 12A to 12D, a difference which is thought to be most important is recognized in the photographs D. The surfaces shown in FIGS. 10A to 10D and 11A to 11D have a feature in the surface morphology in that the surfaces of the fine holes have finer irregularities.

Bases made of iron, nickel and cobalt were also treated with 1,1,1-trichloroethane for degreasing, and then treated with alkaline cleaning solution and then rinsed with water. Subsequently, electrolytic degreasing was performed at ordinary temperature for one to two minutes, followed by rinsing with water, then pickling with 1 : 1 hydrochloric acid and then washing with water. Each base was then held immersed in an electroless nickel-phosphorus alloy plating solution at a bath temperature of 90° C. for three hours, thus obtaining precipitation of a nickel-phosphorus alloy plating film to 70 to 80 μm on the substrate surface. This film was subjected for blackening in an etching treatment in the manner as disclosed in the above. With the ultra-black film obtained in this way, the surface morphology, spectral absorbance and other characteristics were similar to those in case of using the copper base.

Further, a base made of aluminum as metal was treated with 1,1,1-trichloroethane for degreasing, followed by etching with a sodium hydroxide solution at ordinary temperature for three to five minutes. The base was then rinsed with water and then held immersed in a blend solution containing nitric and hydrofluoric acid at ordinary temperature for 15 to 20 seconds for removal of smut formed on the aluminum surface. The base was then rinsed with water, and zinc substitution was performed. Then, it was rinsed with water, and copper strike, nickel strike plating was performed. The base was then held immersed in an electroless nickel-phosphorus alloy plating solution at a bath temperature of 90° C. for three hours, thus obtaining precipitation of a nickel-phosphorus alloy plating film to 70 to 80 μm on the substrate surface. This film was subjected for blackening in an etching treatment in the manner as disclosed in the above. With the ultra-black film obtained in this way, the surface morphology, optical absorbance and other characteristics were similar to those in case of the copper base.

Further, bases which were prepared from brass, bronze, cupronickel, phosphor bronze, stainless steel, eighteen gold, etc., were subjected to the same treatment as for the copper base to cause precipitation of a nickel-phosphorus alloy film for ultra-black film to a thickness of 70 to 80 μm on the base surface, followed by an etching treatment for blackening as disclosed above. With the ultra-black film thus obtained, the surface morphology, optical absorbance and other properties were similar to those of the ultra-black film obtained with the copper base.

Embodiment 17

In this embodiment, ceramic and glass bases were prepared. Since ceramics and glass are electric nonconductors, the base surface was metallized by depositing nicrome by a vacuum deposition process, then depositing gold by a vaccum deposition process and then performing nickel strike plating. Alternatively, the ceramic and glass surfaces may be activated by a chemically reducing process of immersing the bases in a collodial palladium suspension, or immersing the bases in a tin chloride solution and then in a palladium chloride solution. The ceramic and glass bases with their surface metallized or activated were held immersed in an electroless nickel-phosphorus alloy plating solution A or B (A; composed of 0.1 M of nickel surface, 0.25 M of sodium hypophosphite, 0.5 M of D, L-malic acid, 0.4 M of lactic acid and 0.25 M of malonic acid, B; composed of 0.1 M of nickel sulfate, 0.25 M of sodium hypophosphite 0.4 M of D, L-malic acid and 0.45 M of succinic acid) for ultra-black film at a bath temperature of 90° C. for three hours, thus causing precipitation of a nickel-phosphorus alloy plating film to a thickness of 70 to 80 μm on the base surface. Then, the base was subjected to an etching treatment as in Embodiment 17. With the ultra-black films thus obtained, the surface morphology, light reflectance and various other properties were the same as those obtained in Embodiment 17, and no particular difference could be recognized.

Embodiment 18

In this embodiment, a plastic base was prepared. Since plastics are electric non-conductors, the base surface was metallized by a cathode spattering process. Alternatively, the plastic surface may be activated by a chemically reducing process of immersing the bases in a colloidal palladium suspension, or immersing the base in a tin chloride solution and then in a palladium chloride solution. The plastic base with its surface metallized or made active was held immersed in an electroless nickel-phosphorus alloy plating solution A or B (A; composed of 0.1 M of nickel sulfate, 0.25 M of sodium hypophosphite, 0.5 M of D, L-malic acid, 0.4 M of lactic acid and 0.3 M of malonic acid, B; composed of 0.1 M of nickel sulfate, 0.25 M of sodium hypophosphite, 0.4 M of D, L-malic acid and 0.45 M of succinic acid) for ultra-black film at a bath temperature of 90° C. for three hours, thus causing precipitation of a nickel-phosphorus alloy plating film to a thickness of 70 to 80 μm on the plastic base surface. Then, the base was subjected to an etching treatment for blackening as in Embodiment 16. With the ultra-black film thus obtained, the surface morphology, reflectance and various other properties were the same as those obtained in Embodiment 16, and no particular difference could be recognized.

Figure 14:
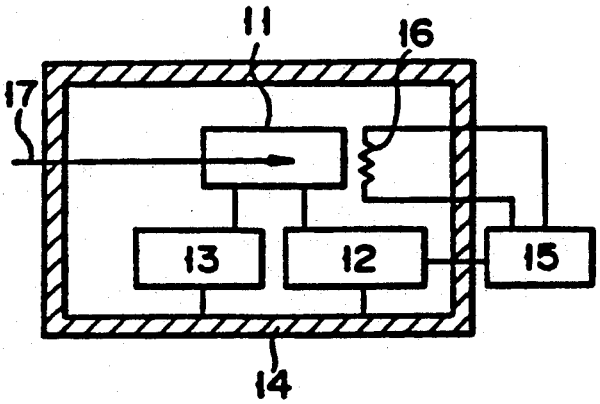
FIG. 14 is a view showing the principles underlying an optical receiver.

Below, an example of application of the ultra-black film that is obtained in the above way as an optical absorber in an optical receiver for optical power measurement will be described. FIG. 14 shows the principles underlying the optical receiver. Optical power, particularly laser beam power, is measured in terms of the power consumed by a heater provided in the optical receiver. Optical receiver 11 is connected through temperature comparison sensor 12 and element 13 to temperature reference jacket 14. Cooling element 13 radiates a constant quantity of heat to reference temperature jacket 14. Temperature difference sensor 12 detects the temperature difference between optical receiver 11 and temperature reference jacket 14, and its output is fed back through controller 15 to heater 16 so that the temperatures of optical receiver 11 and temperature reference jacket 14 are controlled to an equal temperature. When all the power of incident laser beam 17 is entirely absorbed by optical receiver 11, the power of the laser beam is obtained as the difference from the consumed power of the heater necessary for the equal temperature control.

For the measurement of the power of the incident light, the entire incident optical should be absorbed. However, leakage of the incident optical by reflection from the opening of the optical receiver is inevitable. Therefore, the practically required percentage of reflected light escaping through the opening, i.e., the reflection factor of the optical receiver, is 0.1% or less.

Figure 15:
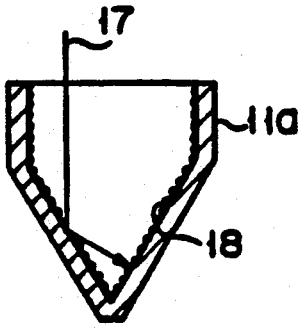
FIGS. 15 to 17 are sectional views showing different examples of optical receiver incorporating the ultra-black film according to the invention.
Figure 16:
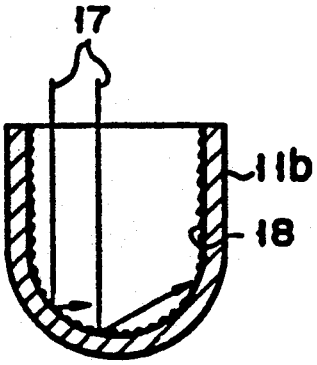
Figure 17:
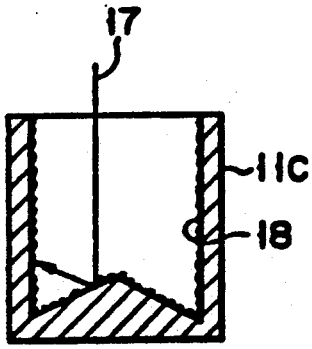

FIG. 15 shows an example of the optical receiver according to the invention. In this instance, ultra-black film 18 according to the invention is formed on the inner surface of cylindrical optical receiver 11. FIGS. 16 and 17 show different examples. In these instances, the invention is applied to optical receivers **11*b* and 11*c*** having closed ends with shapes other than the conical end. In general, it is possible to adopt a optical receiver having any shape so long as it has the required opening diameter and depth and can be coupled to a heater and other necessary elements. The reflection factor of the optical receiver substantially depends on the quantity of the primary reflection of the incident light from the opening, and also the quantity of reflection is maximum in directions symmetric with respect to the direction of the beam incidence. Therefore, the bottom of the optical receiver should be inclined with respect to the direction of incidence. Further, the thermal time constant of the optical receiver is directly related to the mass of the optical receiver. Therefore, the the optical receiver should have the smallest volume for depth. Since the reflectance of the ultra-black film is very low, by applying the ultra-black film according to the invention to an optical receiver, the angle of reflection can be increased for a constant amount of light of primary reflection from the optical receiver. Thus, it is possible to reduce the depth of the optical receiver and reduce the size thereof. Thus, the thermal time constant of the optical receiver can be reduced, so that it is possible to permit accurate measurement of optical power of low energy. Further, it is possible to measure substantially the absolute value of the optical power with or optical receiver having a sufficiently large angle of reflection.

Figure 18:
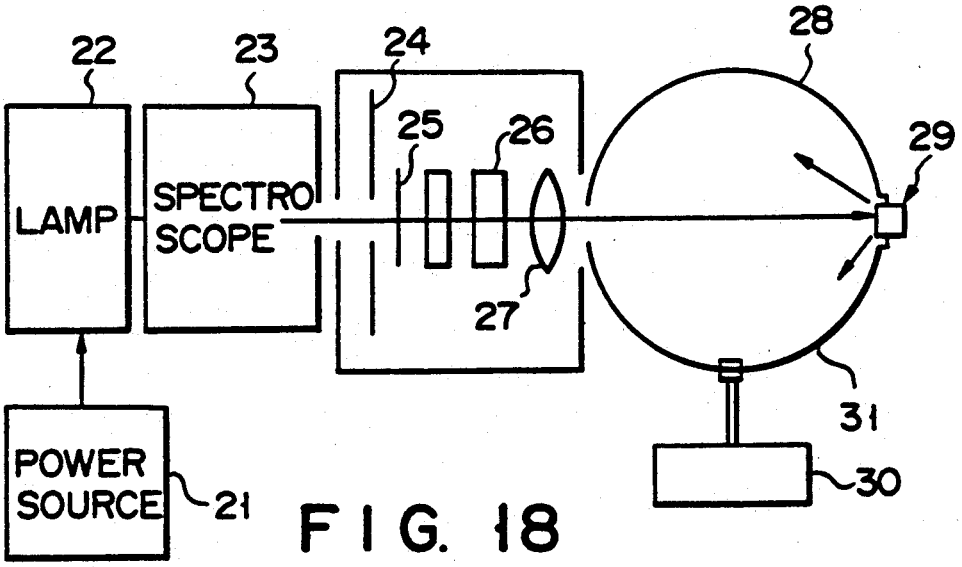
FIG. 18 is a schematic view showing an apparatus for measuring reflectance incorporating the ultra-black film according to the invention.

FIG. 18 illustrates a general apparatus for measuring the reflectance. In the figure, reference number 21 designates power source; 22, lamp; 23, spectroscope; 24, slit; 25, shutter; 26, collection filter; 27, converging lens; 28, integrating sphere; 29, reference reflector or, reflection sample; and 30, optical power meter. Optical receiver 31 comprises the integrating sphere, reference reflector, or reflection sample and optical power meter.

Figure 19:
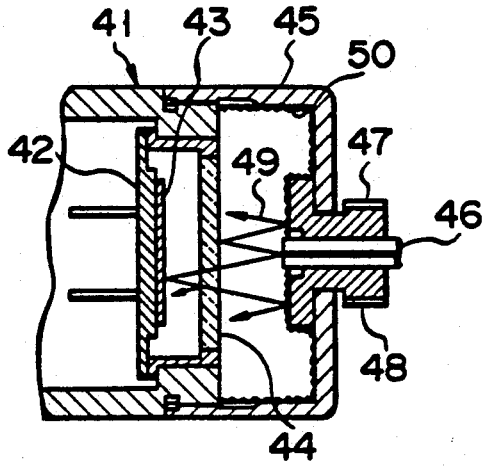
FIG. 19 is a fragmentary sectional view showing the apparatus for measuring reflectance according to the invention.

FIG. 19 is a sectional view showing an optical connector adapter of the same apparatus. Reference number 41 designates photo-sensor; 42, photo diode (PD) case; 43, PD element; 44, glass window; 45, connector adapter; 46, fiber core; 47, ferrule; and 48, receptacle. Arrow 49 indicates incident light. An ultra-black film according to the invention is formed on the inner surface of the connector adapter.

Figure 20:
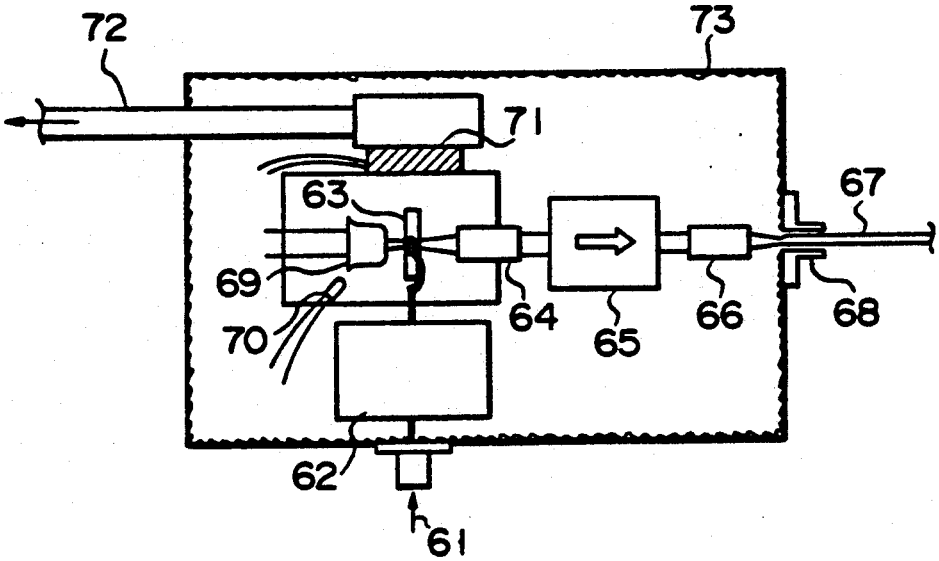
FIG. 20 is a schematic view showing a LED module incorporating the ultra-black film according to the invention.

FIG. 20 shows an LED module. Reference number 61 designates modulation input; 62, LED modulation drive circuit board; 63, LED; 64 and 66, rod lenses; 65, light isolator; 67, optical fiber; 68, optical connector; 69, photodiode for monitor; 70, temperature sensor (thermistor); 71, peltier element; 72, heat pipe. Ultra-black film 73 according to the invention is formed on the inner wall of the LED module.

Figure 21:
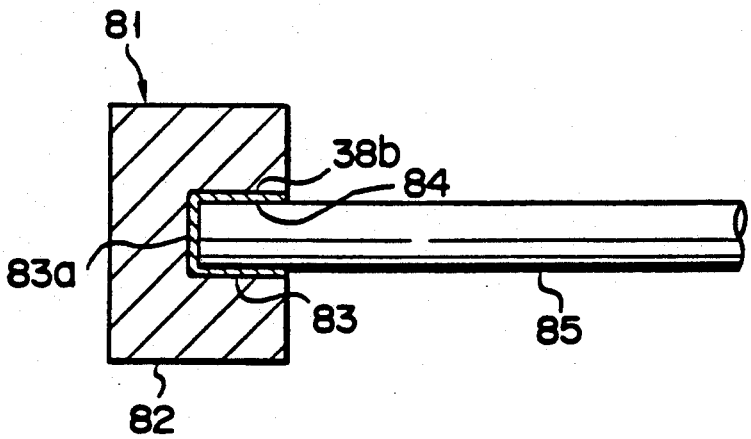
FIG. 21 is a sectional view showing an example of the no reflection optical terminator incorporating the ultra-black film according to the invention.
Figure 22:
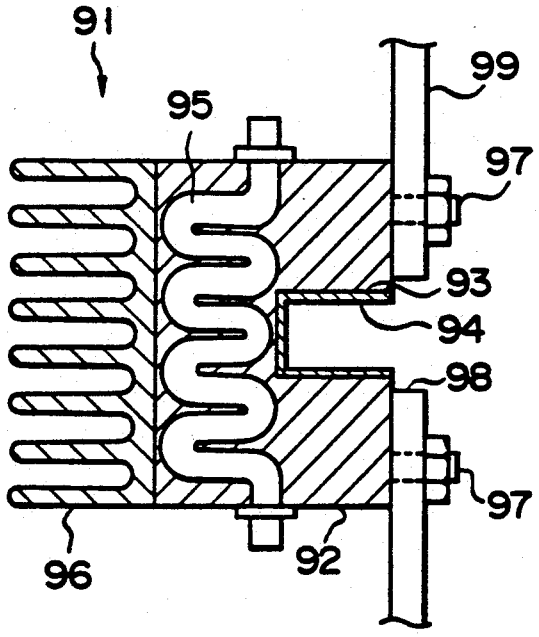
FIG. 22 is a sectional view showing a different example of the no reflection optical terminator incorporating the ultra-black film according to the invention.

FIG. 21 is a sectional view showing no reflection optical terminator 81 utilized as a reference terminator unit when measuring the amount of reflection. In this terminator, one end surface of cap 82 has conical recess 83. Ultra-black film 84 according to the invention is formed on the surfaces, i.e., bottom and side surfaces 83*a* and 83*b*, of the recess. One end of optical fiber 85 is inserted in the recess such that the inserted end is in close contact with ultra-black film 84 in the recess. If necessary, a silicone oil layer may be provided between the ultra-black film and optical fiber to improve the close contact between the two. A pulse light beam incident on the other end of optical fiber 85 is substantially absorbed in the recess of no reflection optical terminator 81, so that there is substantially no possibility that reflected light is returned from the aforementioned one end of the optical fiber to the light incidence side. FIG. 22 shows no reflection optical terminator 91 which is utilized for temporarily receiving light having high energy in a safe state. In this terminal unit 91, cap 92 has recess 93 formed in the front end surface. The ultra-black film according to the invention is provided on the entire inner surface of the recess. Cooling-water ductline 95 is provided inside the cap. Heat dissipation fins 96 are provided on the rear end surface of cap 92. The front end surface of the cap is provided with mounting studs 97. A nut is tightened on each stud 97 from the back side of mounting plate 99 having light incidence hole 98. Cap 92 itself may be made of a ceramic material or the like which can strongly resist heat. When a laser beam is incident in recess 13 through light incidence hole 98 of mounting plate 99, it is absorbed by ultra-black film 94 without being substantially reflected. If cap 92 is elevated in temperature by the energy of the laser beam, it is immediately cooled down by cooling water supplied to the ductline or the heat radiation action of fins 96. Thus, there is no possibility of thermal deformation of cap 92 or thermal denaturing of the ultra-black film. In the terminator shown in FIGS. 21 and 22, the ultra-black film according to the invention is provided on the entire inner surface of the recess. In some cases, it is possible to provide the ultra-black film according to the invention only on the bottom surface of the recess.

(Effect of the Invention)

According to the invention, a nearly ideal ultra-black film is formed through etching of a nickel-phosphorus alloy film by one of the first to fourth methods according to the invention.

The surface of the ultra-black film has innumerable conical holes with opening diameters ranging from 1 to 6 μm and disposed close to one another, the surfaces of the conical holes having innumerable finer irregularities or in the form of ultra-fine irregularities, thus reducing the spectral reflectance in a wide wavelength range. It is thus possible to provide a ultra-black film, which has very low spectral reflectance of 0.04 to 0.1% or 0.1 to 0.4% and low wavelength-dependence of the spectral reflectance, and which also has strong resistance against mechanical vibrations and rubbing and is stable with respect to moisture.

This ultra-black film can be formed on substantially all industrial materials such as metals, ceramics and plastics, it is useful as optical absorber. The obtained ultra-black film is effective as optical absorber for precise absolute optical power measurement or a terminator for an optical transmission system. Further, it can be utilized for a reflection prevention member in an optical apparatus or an optical connector.

TABLE 1

| | U.S. Pat. No. 4233107, 4361630 | Method (1) according to the invention | Method (2) according to the invention |
|---|---|---|---|
| Nickel-phosphorus alloy plating solution: | (1) Nickel sulfate, sodium hypophosphite, sodium hydroxyl acetate, boric acid (2) Nickel chloride, sodium phosphate, | Nippon Kanizen (Co., Ltd.) "S-780" | Nippon Kanizen (Co., Ltd.) "S-780" |
| Etching treatment: | 1:5 $HNO_3$ to concentrated $HNO_3$, temperature: 20 to 100° C. | 1:2 $HNO_3$ to concentrated $HNO_3$ temperature: 20 to 100° C. Nitric acid (200 to 400 g/l + $H_2SO_3$ (400 to 600 g/l), temperature: 30 to 80° C. | Nitric acid (200 to 400 g/l + $H_2SO_3$ (400 to 600 g/l), temperature: 30 to 80° C. |
| Spectral reflectance: | 0.5 to 1.0% (320 to 2,140 nm), there being wavelength dependency | 0.1 to 0.4% (380 to 1,800 nm), wavelength dependence being very low | 0.1 to 0.4% (380 to 1,800 nm), wavelength dependence being very low |
| Black film surface state and hole diameter: | (1) The conical hole distribution is various. (2) Crests are sharp. (3) Hole diameter ranges 1 to 9 μm. | (1) Fine holes have small diameters which are uniformly distrubuted. (2) Hole surfaces have fine irregularities. (3) Hole diameter ranges 1 to 6 μm. | (1) Fine holes have small diameters which are uniformly distrubuted. (2) Hole surfaces have fine irregularities. (3) Hole diameter ranges 1 to 6 μm. |

| | Method (3) according to the invention | | Method (4) according to the invention |
|---|---|---|---|
| Nickel-phosphorus alloy plating solution: | Nickel sulfate, sodium hypophosphite D, L-malic acid, malonic acid | Nickel-phosphorus alloy plating liquid: | (1) Nickel sulfate, sodium hypophosphite D, L-malic acid, succinic acid (2) Nickel sulfate, sodium hypophosphite D, L-malic acid, malonic acid |
| Etching treatment: | Nitric acid (200 to 400 g/l) + $H_2SO_4$ (400 to 600 g/l), temperature: 30 to 80° C. | Etching treatment: | 1:2 $HNO_3$ to concentrated $HNO_3$ temperature: 20 to 100° C. |
| Spectral reflectance: | 0.1 to 0.4% (380 to 1,800 nm), wavelength dependency being | Spectral reflectance: | 0.04 to 0.1% (380 to 1,800 nm), wavelength dependence being |

TABLE 1-continued

| | | | |
|---|---|---|---|
| Black film surface state and hole diameter: | very low<br>(1) Innumerable ultra-fine irregularities<br>(2) Irregular surfaces are cotton-like or hair cloth-like | Black film surface state and hole diameter: | very slight<br>(1) Fine holes have small diameters which are substantially uniformly distributed.<br>(2) Fine hole surface have finer irregularities.<br>(3) Hole diameter ranges 1 to 6 μm. |

The etching conditions of the invention are examples.

What is claimed is:

1. A method of manufacturing an ultra-black film having a spectral reflectance of 0.1 to 0.4% comprising the steps of:

forming a nickel-phosphorus alloy film on a base by an electroless plating process;

subjecting the surface of said nickel-phosphorus alloy film to a primary etching treatment with an aqueous nitric acid solution; and subjecting said film after said primary etching treatment to a secondary etching treatment with a sulfuric-acid-containing nitrate solution.

2. The method according to claim 1, wherein said electroless plating is performed by holding said base immersed in an electroless nickel-phosphorus plating solution at a temperature of 80 to 95° C. substantially for 1 to 5 hours.

3. The method according to claim 1, wherein said electroless plating process comprises the steps of:

effecting degreasing of the base made of an electric conductor with 1,1,1-trichloroethane and alkaline cleaning solution;

performing nickel strike plating on the base surface; and forming a nickel-phosphorus alloy plating film on the base surface by immersing said base in an electroless nickel-phosphorus alloy plating solution.

4. The method according to claim 1, wherein said plating process comprises the steps of:

preparing a base made of an electric non-conductor; sensitizing the surface of the base with tin chloride solution; activating the surface with palladium chloride solution; and subsequently forming a nickel-phosphorus alloy plating film on the base surface by immersing said base in an electroless nickel-phosphorus alloy plating solution.

5. The method according to claim 1, wherein said nickel-phosphorus alloy plating film formed on the base surface consists essentially consists of approximately 7 to 10% by weight of phosphorus and the balance of nickel and inevitable impurities.

6. The method according to claim 2, wherein said primary etching treatment is performed by using an aqueous nitric acid solution comprising at least one part by volume to nitric acid for 2 parts by volume of water and holding said base immersed in said aqueous nitric acid solution at a temperature of 20 to 100° C. for 5 seconds to 5 minutes.

7. The method according to claim 12, wherein said secondary etching treatment is performed by using an aqueous nitrate solution comprising 200 to 450 g/l of sodium nitrate and 300 to 700 g/l of sulfuric acid and holding said base immersed in said aqueous nitrate solution at 30 to 80° C. for 5 seconds to 5 minutes.

8. The method according to claim 7, wherein said secondary etching treatment is performed by using an aqueous nitrate solution comprising 300 to 400 g/l of sodium nitrate and 400 to 600 g/l of sulfuric acid.

9. A method of forming an ultra-black film with a spectral reflectance of 0.1 to 0.4% on a base, comprising the steps of:

forming a nickel-phosphorus alloy film on said base by electroless plating; and effecting an etching treatment of the surface of said nickel-phosphorus alloy film with a sulfuric-acid-containing nitrate solution to form said ultra-black film.

10. The method according to claim 9, wherein said electroless plating is performed by holding said base immersed in an electroless nickel-phosphorus plating solution at a temperature of 80 to 95° C. about for 1 to 5 hours.

11. The method according to claim 9, wherein said plating process comprises the steps of:

effecting degreasing of the base made of an electric conductor with 1,1,1-trichloroethane and alkaline cleaning solution;

performing nickel strike plating on the base surface; and forming a nickel-phosphorus alloy plating film on the base surface by immersing said base in an electroless nickel-phosphorus alloy plating solution.

12. The method according to claim 9, wherein said electroless plating process comprises the steps of:

preparing a base made of an electric non-conductor; sensitizing the surface of the base with tin chloride solution; activating the surface with palladium chloride solution; and subsequently forming a nickel-phosphorus alloy plating film on the base surface by immersing said base in an electroless nickel-phosphorus alloy plating solution.

13. The method according to claim 1, wherein said nickel-phosphorus alloy plating film formed on the base surface consists essentially of approximately 7 to 10% by weight of phosphorus and the balance of nickel and inevitable impurities.

14. The method according to claim 9, wherein said etching treatment is performed by using an aqueous nitrate solution comprising 200 to 450 g/l of sodium nitrate and 300 to 700 g/l of sulfuric acid and holding said base immersed in said aqueous nitrate solution at to 80° C. for 5 seconds to 5 minutes.

15. The method according to claim 14, wherein said etching treatment is performed by using an aqueous nitrate solution comprising 300 to 400 g/l of sodium nitrate and 400 to 600 g/l of sulfuric acid.

16. A method of manufacturing an ultra-black film having an spectral reflectance of 0.1 to 0.4% comprising the steps of:

forming a nickel-phosphorus alloy film on a base by using an electroless plating solution comprising nickel salt, sodium hypophosphite, D, L-malic acid or salt thereof and malonic acid or salt thereof; and effecting an etching treatment of the surface of said nickel-phosphorus alloy film with a sulfuric acid-containing aqueous nitrate solution.

17. The method according to claim 16, wherein said electroless plating solution comprising 0.11 to 0.20 M, of nickel salt, 0.24 to 0.36 M of sodium hypophosphite, 0.40 to 0.80 M of D, L-malic acid or salt thereof and 0.20 to 0.40 M of malonic acid or salt thereof.

18. The method according to claim 16, wherein said electroless plating is performed by holding said base immersed in an electroless nickel-phosphorus plating solution at a temperature of 80 to 95° C. about for 10 minutes to three hours.

19. The method according to claim 16, wherein said electroless plating process comprises the steps of:

effecting degreasing of the base made of an electric conductor with 1,1,1-trichloroethane and alkaline cleaning solution;

performing nickel strike plating on the base surface; and forming a nickel-phosphorus alloy plating film on the base surface by immersing said base in an electroless nickel-phosphorus alloy plating solution.

20. The method according to claim 16, wherein said plating process comprises the steps of:

preparing a base made of an electric non-conductor; sensitizing the surface of the base with tin chloride solution; activating the surface with palladium chloride solution; and subsequently forming a nickel-phosphorus alloy plating film on the base surface by immersing said base in an electroless nickel-phosphorus alloy plating solution.

21. The method according to claim 16, wherein said nickel-phosphorus alloy plating formed on the base surface consists essentially of approximately 7 to 10% by weight of phosphorus and the balance of nickel and inevitable impurities.

22. The method according to claim 16, wherein said etching treatment is performed by using an aqueous nitrate solution comprising 200 to 450 g/l of sodium nitrate and 300 to 700 g/l of sulfuric acid.

23. The method according to claim 22, wherein said etching treatment is performed by using an aqueous nitrate solution comprising 300 to 400 g/l of sodium nitrate and 400 to 600 g/l of sulfuric acid.

24. A method of forming an ultra-black film having a spectral reflectance of 0.04 to 0.1% on a base comprising the steps of:

forming a nickel-phosphorus alloy film on a base by using a member selected from the group consisting of an electroless plating solution comprising a nickel salt, sodium phosphate, D, L-malic acid or salt thereof and succinic acid or salt thereof and a plating solution comprising a nickel salt, sodium phosphate, D, L-malic acid or salt thereof, latic acid or salt thereof and malonic acid or salt thereof; and a step of effecting an etching treatment of the surface of said nickel-phosphorus alloy film with an aqueous nitric acid solution to form an ultra-black film.

25. The method according to claim 24, wherein a plating solution is used, which comprise 0.11 to 0.20 M of nickel salt, 0.24 to 0.36 M of sodium hypophosphite, 0.40 to 0.80 M of D, L-malic acid or salt thereof and 0.4 to 0.8 M of malonic acid or salt thereof.

26. The method according to claim 24, wherein a plating solution is used, which comprises 0.11 to 0.20 M of nickel salt, 0.24 to 0.36 M of sodium hypophosphite 0.2 to 0.4 M of D, L-malic acid or salt thereof, 0.3 to 0.6 M of lactic acid or salt thereof and 0.20 to 0.40 M of malonic acid or salt thereof.

27. The method according to claim 24, wherein said electroless plating is performed by holding said base immersed in an electroless nickel-phosphorus plating solution at a temperature of 80 to 95° C. about for 1 to 5 hours.

28. The method according to claim 24, wherein said plating process comprises the steps of:

effecting degreasing of the base made of an electric conductor with 1,1,1-trichloroethane and alkaline cleaning solution;

performing nickel strike plating on the base surface; and forming a nickel-phosphorus alloy plating film on the base surface by immersing said base in an electroless nickel-phosphorus alloy plating solution.

29. The method according to claim 24, wherein said plating process comprises the steps of: preparing a base made of an electric non-conductor; sensitizing the surface of the base with tin chloride solution; activating the surface with passadium chloride solution; and subsequently forming a nickel-phosphorus alloy plating film on the base surface by immersing said base in an electroless nickel-phosphorus alloy plating solution.

30. The method according to claim 24, wherein said nickel-phosphorus alloy plating film formed on the base surface consists essentially of approximately 7 to 10% by weight of phosphorus and the balance of nickel and inevitable impurities.

31. The method according to claim 24, wherein said etching treatment is performed by using an aqueous nitric acid solution comprising at least one part by volume of nitric acid for 2 parts by volume of water and holding said base immersed in said aqueous nitric acid solution at a temperature of 30 to 80° C. for 10 seconds to 5 minutes.

32. The method according to claim 9, wherein said electroless plating process further comprises the steps of: preparing a base made of an electric non-conductor; and metallizing the surface of the base by depositing metal thereon.

33. The method according to claim 2, wherein said nickel-phosphorus alloy plating film formed on the base surface consists of essentially of approximately 7 to 10% by weight of phosphorus and the balance being nickel and inevitable impurities;

said primary nitric acid solution comprising at least one part by volume of nitrate for 2 parts by volume of water and holding said base immersed in said aqueous nitric acid solution at a temperature of 20 to 100° C. for 5 seconds to 5 minutes; and said secondary etching treatment being performed by using an aqueous nitrate solution comprising 200 to 450 g/l of sodium nitrate and 300 to 700 g/l of sulfuric acid and holding said base immersed in said aqueous nitrate solution at 30 to 80° C. for 5 seconds to 5 minutes.

34. The method according to claim 10, wherein said nickel-phosphorus alloy plating film formed on the base surface consists essentially of approximately 7 to 10% by weight of phosphorus and the balance being nickel and inevitable impurities; and said etching treatment being performed by using an aqueous nitrate solution comprising 200 to 450 g/l of sodium nitrate and 300 to 700 g/l of sulfuric acid and holding said base immersed in said aqueous solution at 30 to 80° C. for 5 seconds to 5 minutes.

35. The method according to claim 17, wherein said electroless plating is performed by holding said base immersed in an electroless nickel-phosphorus plating solution at a temperature of 80 to 95° C. for 10 minutes to three hours;

said nickel-phosphorus alloy plating formed on the base surface consists essentially of approximately 7 to 10% by weight of phosphorus and the balance being nickel and inevitable impurities; and said etching treatment being performed by using an aqueous nitrate solution comprising 200 to 450 g/l of sodium nitrate and 300 to 700 g/l of sulfuric acid.

36. The method according to claim 25, wherein said electroless plating being performed by holding said base immersed in an electroless nickel-phosphorus plating solution at a temperature of 80 to 95° C. for 1 to 5 hours;

said nickel-phosphorus alloy plating film formed on the base surface consists essentially of approximately 7 to 10% by weight of phosphorus and the balance being nickel and inevitable impurities; and said etching treatment being performed by using an aqueous nitric acid solution comprising at least one part by volume of nitric acid for 2 parts by volume of water and holding said base immersed in said aqueous nitric acid solution at a temperature of 30 to 80° C. for 10 seconds to 5 minutes.

37. The method according to claim 26, wherein said electroless plating being performed by holding said base immersed in an electroless nickel-phosphorus plating solution at a temperature of 80 to 95° C. for 1 to 5 hours;

said nickel-phosphorus alloy plating film formed on the base surface consists essentially of approximately 7 to 10% by weight of phosphorus and the balance being nickel and inevitable impurities; and said etching treatment being performed by using an aqueous nitric acid solution comprising at least one part by volume of nitric acid for 2 parts by volume of water and holding said base immersed in said aqueous nitric acid solution at a temperature of 30 to 80° C. for 10 seconds to 5 minutes.

* * * * *